US006525758B2

(12) United States Patent
Gaudiana et al.

(10) Patent No.: US 6,525,758 B2
(45) Date of Patent: Feb. 25, 2003

(54) INTEGRAL ORGANIC LIGHT EMITTING DIODE FIBER OPTIC PRINTHEAD UTILIZING COLOR FILTERS

(75) Inventors: Russell A. Gaudiana, Merrimack, NH (US); Richard G. Egan, Dover, MA (US); Bennett H. Rockney, Westford, MA (US); Joseph DelPico, Brockton, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 09/750,558

(22) Filed: Dec. 28, 2000

(65) Prior Publication Data

US 2002/0122108 A1 Sep. 5, 2002

(51) Int. Cl.[7] ..... B41J 2/45
(52) U.S. Cl. ..... 347/238; 347/130
(58) Field of Search ..... 347/130, 234, 347/238, 248, 232; 430/383; 349/69, 70, 104, 106; 313/463, 504, 506; 257/40

(56) References Cited

U.S. PATENT DOCUMENTS

| | | | | |
|---|---|---|---|---|
| 4,447,126 | A | 5/1984 | Heidrich et al. | 385/119 |
| 4,602,263 | A | 7/1986 | Borror et al. | 503/201 |
| 4,715,682 | A | 12/1987 | Koek et al. | 359/820 |

(List continued on next page.)

OTHER PUBLICATIONS

S. Forrest, et al., The Dawn of Organic Electronics, IEEE Spec., vol. 37, No. 8, pp. 29–34, Aug. 2000.

Y. Tsuruoka, et al., 40.2: Application of Organic Electroluminescent Device To Color Print; 2000, SID 00 Digest; pp. 978–981.

WIPO Publication, WO 99/36261, Jul. 22, 1999.

K. Inukai, et al., 36–4L: Late–News Paper: 4.0–in. TFT–OLED Displays and a Novel Digital Driving Method; pp. 924–927, 2000, SID 2000 Digest.

WIPO Publication, WO 99/20081, Apr. 22, 1999.

WIPO Publication, WO 98/06122, Feb. 12, 1998.

WIPO Publication, WO 99/39393, Aug. 5, 1999.

*Primary Examiner*—Hai Pham

(57) ABSTRACT

A compact light weight printhead capable of direct quasi-contact printing includes an OLED—Color Filter structure disposed on a fiber optic faceplate substrate. The OLED—Color Filter structure includes an OLED structure emitting over a broad range of wavelengths and color filter arrays that selectively transmit radiation in different distinct ranges of wavelengths. The printhead is designed for contact or quasi-contact printing printing. The printhead design ensures that the desired pixel sharpness and reduced crosstalk is achieved. Two possible different arrangements for the printhead are disclosed. One arrangement includes at least one array of OLED elements and at least one color filter array. Each color filter array in this arrangement includes at least one triplet of color filters, and each element in each the triplet is capable of transmitting radiation in a distinct wavelength range different from the distinct wavelength range of the other two color filters in the same triplet. In the second arrangement, the printhead includes at least one triplet of arrays of individually addressable Organic Light Emitting Diode (OLED) elements and at least one triplet of arrays of color filter elements, each OLED array in the triplet being in effective light transmission relation to the light receiving surface of one color filter array in the triplet thereby constituting an OLED—Color filter array set. In this second arrangement, each color filter array in each triplet has elements that are capable of transmitting radiation in a distinct wavelength range different from the distinct wavelength range of the other two arrays in the triplet.

43 Claims, 12 Drawing Sheets

OLED Printer with F/O Face Plate on Top of Mask

U.S. PATENT DOCUMENTS

| | | | | |
|---|---|---|---|---|
| 4,720,449 | A | | 1/1988 | Borror et al. ..... 430/338 |
| 4,720,450 | A | | 1/1988 | Ellis ..... 430/339 |
| 4,745,046 | A | | 5/1988 | Borror et al. ..... 430/332 |
| 4,818,742 | A | | 4/1989 | Ellis ..... 503/201 |
| 4,826,976 | A | | 5/1989 | Borror et al. ..... 544/58.4 |
| 4,839,335 | A | | 6/1989 | Ellis ..... 503/224 |
| 4,894,358 | A | | 1/1990 | Filosa et al. ..... 503/201 |
| 4,921,316 | A | | 5/1990 | Fantone et al. ..... 385/120 |
| 4,960,901 | A | | 10/1990 | Borror et al. ..... 548/207 |
| 5,582,956 | A | | 12/1996 | Ehret et al. ..... 430/337 |
| 5,631,118 | A | | 5/1997 | Gaudiana et al. ..... 430/270.1 |
| 5,756,240 | A | | 5/1998 | Roberts et al. ..... 430/7 |
| 5,874,188 | A | | 2/1999 | Roberts et al. ..... 430/7 |
| 5,900,339 | A | | 5/1999 | Roberts et al. ..... 430/7 |
| 5,920,080 | A | | 7/1999 | Jones ..... 257/40 |
| 5,929,474 | A | | 7/1999 | Huang et al. ..... 257/292 |
| 5,952,789 | A | | 9/1999 | Stewart et al. ..... 315/169.4 |
| 5,981,112 | A | | 11/1999 | Roberts et al. ..... 430/7 |
| 6,004,719 | A | | 12/1999 | Gaudiana et al. ..... 430/270.1 |
| 6,023,073 | A | * | 2/2000 | Strite ..... 257/40 |
| 6,064,418 | A | | 5/2000 | Shimizu et al. ..... 347/238 |
| 6,069,443 | A | | 5/2000 | Jones et al. ..... 313/504 |
| 6,163,363 | A | * | 12/2000 | Nelson et al. ..... 355/32 |
| 6,181,062 | B1 | * | 1/2001 | Hiraishi et al. ..... 313/504 |
| 6,232,050 | B1 | * | 5/2001 | Hirai et al. ..... 430/383 |
| 6,339,291 | B1 | * | 1/2002 | Codama ..... 313/506 |

* cited by examiner

INTEGRAL ORGANIC LIGHT EMITTING DIODE FIBER OPTIC PRINTHEAD UTILIZING COLOR FILTERS

BACKGROUND OF THE INVENTION

1. Field of the Invention

This invention relates generally to compact, light weight printheads and, more particularly, to integral Organic Light Emitting Diode (OLED) fiber optic printheads.

2. Background

Light emitting diodes (LED) have been used for exposing photosensitive materials such as photographic film or photographic paper or photocopying receptors. The light emitting diodes are usually arranged in a linear array or a number of linear arrays and means are provided for a relative displacement of the photosensitive materials in relation to the array. In this manner, the material is scanned past the array and an area is exposed thereby creating an image.

The light emitted from LEDs diverges quickly and thus reduces the exposing intensity and increases the exposing area. This can lead to a reduction in sharpness of the exposed image and to the possibility of undesired exposure of adjacent areas. The first of these problems is known as reduced pixel sharpness and the second is known as crosstalk. To avoid these difficulties, optical systems are utilized to transmit the light from the LEDs to the photosensitive material without significant divergence. While this approach results in an acceptable printing system, such systems have their size defined by the optical systems and therefore are not as compact as would be desired for a portable print system.

Organic Light Emitting Diodes (OLED), which have been recently developed, (See, for example, the article by S. Forrest, P. Burrows, M. Thompson, "*The dawn of organic electronics*", IEEE Spectrum, Vol. 37, No. 8, pp. 29–34, August 2000) hold a promise of ease of fabrication and low cost and low power consumption. A recent publication (Y. Tsuruoka et. al., "Application of Organic electroluminescent Device to Color Print Head", SID 2000 Digest, pp. 978–981), describes a print head utilizing OLEDs. The printhead described in this publication is comprised of discrete OLEDs, color filters and optical elements and therefore is not as compact as desired. Also, the presence of discrete optical elements requires considerations of alignment which have an impact on manufacturability and cost.

While it would be preferable to dispense with the use of optical elements (see related applications Ser. No. 09/749,346 and Ser. No. 09/745,042) there are some cases of interest where obtaining the best printing conditions requires using optical elements. Among the proposed optical elements that have been proposed by others are arrays of graded index lenses and arrays of graded index optical fibers. Both of these proposed solutions (see for example, U.S. Pat. No. 4,447,126, entitled "Uniformly Intense Imaging by Close Packed Lens Array", by P. Heidrich et al., and U.S. Pat. No. 4,715,682, entitled "Mount for Imaging Lens Array on Optical Printhead", by K. Koek et al.,) require considerations of alignment and assembly.

An Integral Fiber Optic printhead which utilizes electrical connection means to connect the light emitting diodes to conductive lines on the substrate has been described in U.S. Pat. No. 4,921,316 (Fantone et al., Integral Fiber Optic Printhead). The light emitting diodes used in present printers (see for example, Shimizu et al., LED Arrays, Print Head, and Electrophotographic Printer, U.S. Pat. No. 6,064,418, May 16, 2000) emit radiation from the surface of a p-n junction (constitute edge emitters) and are typically mounted on a printed circuit board. These characteristics of the LEDs used in previous printers impose constraints on manufacturability and on the ability to optimize performance.

It is the primary object of this invention to provide an integral printhead which is compact, light weight, requires minimal alignment and utilizes Organic Light Emitting Diodes (OLED). It is a further object of this invention to provide an integral printhead which provides the necessary pixel sharpness while avoiding crosstalk and which utilizes Organic Light Emitting Diodes (OLED). Other objects of this invention will become apparent hereinafter.

SUMMARY

To provide a printhead that is light weight and compact, which is the primary object of this invention, an OLED—Color Filter structure is disposed onto a fiber optic faceplate substrate. The fiber optic faceplate substrate has a substantially planar light receiving surface oppositely spaced apart with respect to a substantially planar light emitting surface. The fiber optic faceplate comprises a plurality of individual glass fibers which are stacked together, pressed and heated under pressure to form a uniform structure with a plurality of light transmitting passages extending between the light receiving and light emitting surfaces. The OLED—Color Filter structure is placed on the light receiving surface of the fiber optic faceplate substrate. The OLEDs emit radiation over a broad range of wavelengths. The color filter elements selectively transmit radiation in a different distinct range of wavelengths. In these embodiments, the color filters determine the wavelength range. To provide an integral printhead that provides the necessary pixel sharpness while avoiding crosstalk, the printhead is designed for direct printing with the desired pixel sharpness and reduced crosstalk.

In one embodiment, the OLED—Color Filter structure comprises at least one elongated array of color filter elements deposited onto the fiber optic faceplate substrate and at least one elongated array of individually addressable Organic Light Emitting Diode (OLED) elements deposited onto the color filter array. The OLED elements are aligned with the respective color filter elements. Two possible different arrangements for the printhead are disclosed. In one arrangement, each color filter array in the printhead comprises at least one of a plurality of triplets of color filters, and each element in each said triplet being capable of transmitting radiation in a distinct wavelength range different from the distinct wavelength range of the other two color filters in the same triplet. In the second arrangement, the printhead comprises at least one of a plurality of triplets of elongated arrays of individually addressable Organic Light Emitting Diode (OLED) elements and at least one of a plurality of triplets of elongated arrays of color filter elements, each OLED array in the triplet being in effective light transmission relation to the light receiving surface of one color filter array in the triplet thereby constituting an OLED—Color filter array set. Each set in the triplet is aligned in substantially parallel relation to any other set in the triplet. Each color filter array in each triplet has elements that are capable of transmitting radiation in a distinct wavelength range different from the distinct wavelength range of the other two arrays in the triplet.

In second embodiment, the OLED—Color Filter structure comprises a substrate having a planar first surface opposite to a planar second surface and an individually addressable Organic Light Emitting Diode (OLED) structure. The OLED structure comprising at least one elongated array of individually addressable Organic Light Emitting Diode (OLED) elements and deposited onto the first surface of the substrate. A substantially transparent layer is deposited onto the OLED structure. The substantially transparent layer has a light receiving surface in effective light transmission relation to the OLED structure, the light receiving surface being located opposite to a light emitting surface. At least one of a plurality of elongated array of color filter elements is deposited onto and in effective light transmission relation to the light emitting surface of the transparent layer. The OLED—Color Filter structure is disposed on and mechanically coupled to fiber optic faceplate. Again, the same two alternative arrangements previously disclosed are applicable for this embodiment.

A third embodiment of the OLED—Color Filter structure comprises a substrate having a planar first surface opposite to a planar second surface, an individually addressable Organic Light Emitting Diode (OLED) structure, the OLED structure comprising at least one elongated array of individually addressable Organic Light Emitting Diode (OLED) elements and deposited onto the first surface of the substrate. At least one of a plurality of elongated array of color filter elements is deposited onto the OLED structure. A substantially transparent layer is deposited onto the color filter array. The substantially transparent layer has a light receiving surface in effective light transmission relation to the color filter array, the light receiving surface being located opposite to a light emitting surface. The OLED—Color Filter structure is disposed on and mechanically coupled to fiber optic faceplate. The same two alternative arrangements previously disclosed are applicable for this embodiment.

The parameters—the distance between color filter elements, the characteristic dimensions of the color filter elements, the distance between the light emitting surface of the fiber optic faceplate substrate and the photosensitive material, the numerical aperture of the optical fibers, and the distance between the OLED elements and the color filter elements—are selected to optimize the exposure of the photosensitive material at a given pixel area corresponding to a given color filter array element, due to the light intensity from the elements of the array which are adjacent to said given color filter element and from the given color filter element. An exposure is optimized if the Subjective Quality Factor (SQF) of the resulting pixel is as close to 100 as possible and if the intersection of the normalized intensity profile produced by an adjacent color filter array element at given pixel locations with the normalized intensity profile produced by the corresponding color filter array element is as close to 0.5 as possible.

Imageable materials or colorants can be used to form the color filter elements.

The printheads of this invention can be used to expose the entire gamut of photosensitive materials, for example, silver halide film, photosensitive paper, dry silver, photocopyng receptor material, imageable materials comprised of dyes, acid amplifiers and other photosensitive compounds.

These embodiments provide printheads that are light weight and compact, where an OLED—Color Filter structure is disposed on a fiber optic faceplate substrate. The printheads are designed for direct quasi-contact printing with the desired pixel sharpness and reduced crosstalk. By virtue of their compactness and their light weight, as well as the low power requirements of OLED elements, the printheads of this invention enable the construction of portable printing devices for the mobile data environment.

DESCRIPTION OF THE DRAWINGS

The novel features of this invention are set forth in the appended claims. However, the invention will be best understood from the following detailed description when read in connection with the accompanying drawings wherein:

DETAILED DESCRIPTION

To provide a printhead that is light weight and compact, which is the primary object of this invention, an OLED structure is disposed onto a substrate and the printhead is designed for direct printing with the desired pixel sharpness and reduced crosstalk. In order to achieve this objective, radiation in at least three separate wavelength ranges must be delivered to the medium. In some cases, physical constraints do not permit obtaining the desired pixel sharpness and reducing crosstalk while direct printing without optical elements. In those cases, a fiber optic faceplate substrate provides an optical component that allows for ease of assembly and results in a compact printhead.

An Integral Fiber optic printhead which utilizes electrical connection means to connect the light emitting diodes to conductive lines on the substrate has been described in U.S. Pat. No. 4,921,316 (Fantone et al., Integral Fiber Optic Printhead), which is hereby included by reference. The light emitting diodes used in present printers (see for example, Shimizu et al., LED Arrays, Print Head, and Electrophotographic Printer, U.S. Pat. No. 6,064,418, May 16, 2000) emit radiation from the surface of a p-n junction (constitute edge emitters) and are typically mounted on a printed circuit board. The differences between these LEDs and the OLED of this invention will be apparent from the description that follows. Due to these differences, the LEDs used in previous printers impose constraints on manufacturability and the ability to optimize performance.

The present invention utilizes OLEDs to eliminate alignment and to integrate the assembly. A class of embodiments of printheads utilizing OLEDs and a fiber optic faceplate that achieve the stated objective are disclosed in this application. A second class of embodiments is disclosed in a related application Ser. No. 09/742,246. In the type of embodiments disclosed in this application, an OLED—Color Filter structure containing OLED elements emitting radiation over a broad range of wavelengths and color filters that selectively transmit radiation in a distinct range of wavelengths is disposed onto the fiber optic faceplate. In all color printer embodiments, radiation in at least three separate wavelength ranges must be delivered to the medium. In the embodiments disclosed below, the color filters determine the wavelength ranges.

Two classes of embodiments of an OLED—Color Filter structure disposed onto a fiber optic faceplate are presented below. In the first class of embodiments, the OLED—Color Filter structure is deposited onto the fiber optic faceplate. In the second class of embodiments, the OLED—Color Filter structure is mechanically attached to the fiber optic faceplate.

OLED—Color Filter Structure Deposited Onto The Fiber Optic Faceplate

Figure 1A:
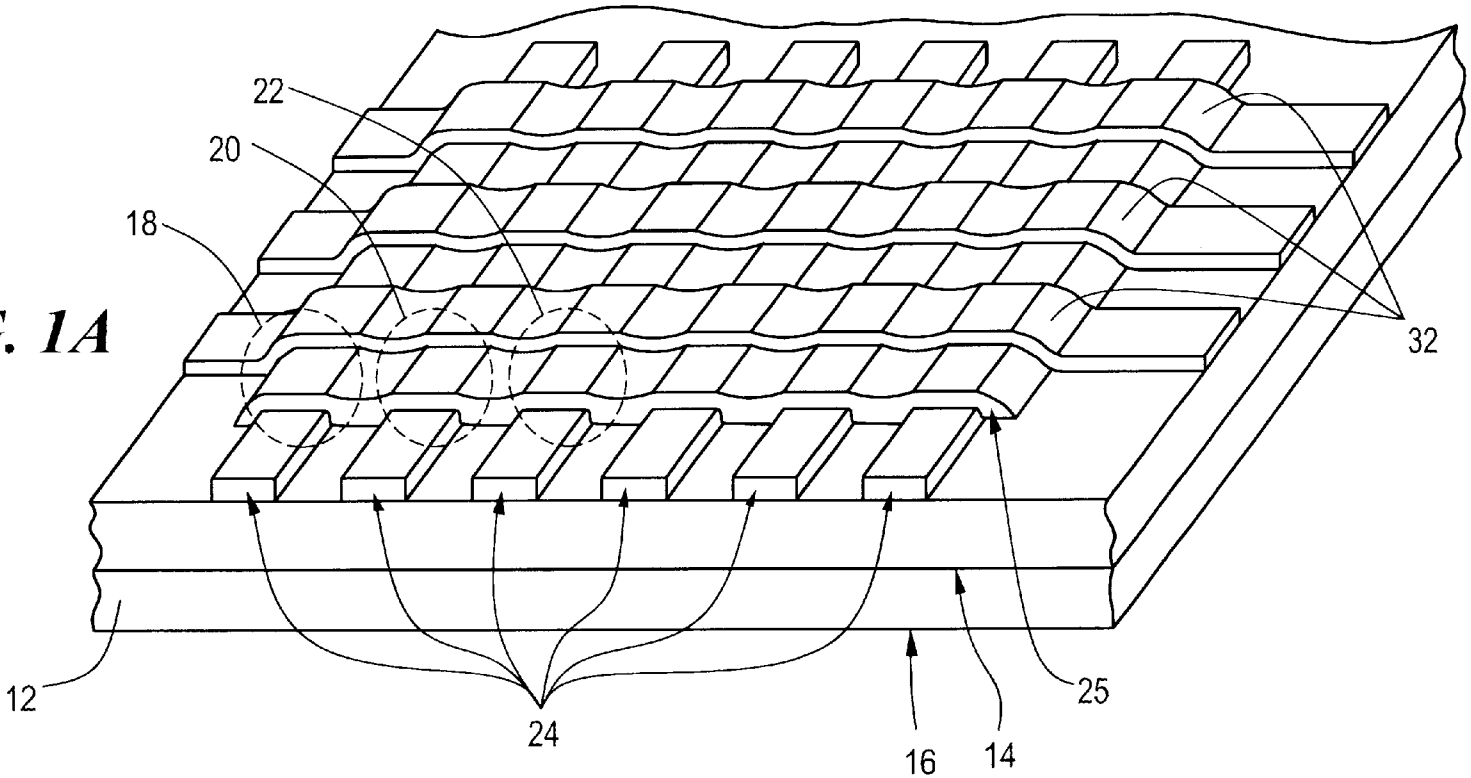
FIG. 1A depicts a graphical representation of the an embodiment of an OLED printhead and illustrates the components of a passively addressable OLED structure.
Figure 1B:
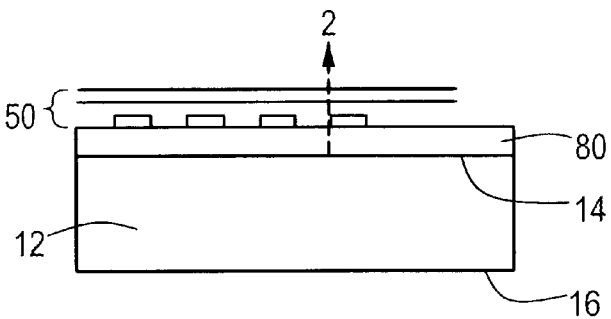
FIG. 1B is a side view of the graphical representation of FIG. 1A and indicates the view used for FIG. 2.

A graphical representation of one embodiment of this invention is shown in FIG. 1, which illustrates the elements of a printhead typical of this invention. Referring to FIGS. 1–3, a printhead assembly of one embodiment of this invention is shown at 10. As shown in FIG. 1, an elongated coherent fiber optic faceplate substrate 12, having a substantially planar light receiving surface 14 oppositely spaced apart from and substantively parallel to a substantially planar light emitting surface 16, serves as a base on which to deposit the color filter array 80. The fiber optic faceplate comprises a plurality of individual glass fibers which are stacked together, pressed and heated under pressure to form a uniform structure with a plurality of light transmitting passages extending between the light receiving and light emitting surfaces 14 and 16. The fiber optic faceplate substrate could comprise solely a fiber optic faceplate or could, as well, comprise a fiber optic faceplate embedded in a glass substrate. The color filter array layer 80 is deposited onto and in effective light transmission relation to the light receiving surface 14 of the substrate 12. The color filter elements selectively transmit radiation in a distinct range of wavelengths, and have a substantially planar color filter light receiving surface appositively spaced apart from and substantively parallel to a substantially planar color filter light emitting surface. The OLED structure 50, comprising arrays 18, 20, 22 of individually addressable Organic Light Emitting Diode (OLED) elements is deposited onto the color filter light receiving surface. (As will be readily understood, deposition on a substrate also includes preparing the surface by planarizing it or passivating it, if any preparation is needed; passivation could include depositing a very thin layer of another material) In one embodiment, the OLED structure consists of transparent anode rows 24, organic layers 25 and cathode columns 32. The OLED is energized when a voltage is placed across the anode and cathode terminals. An OLED array is defined by the array of intersections of the anode rows and cathode columns. The OLED arrays 50 emit light (the term "light "is synonymous to radiation) over a broad range of wavelengths, for example, over the entire visible range as a white emitter would.

Figure 2A:
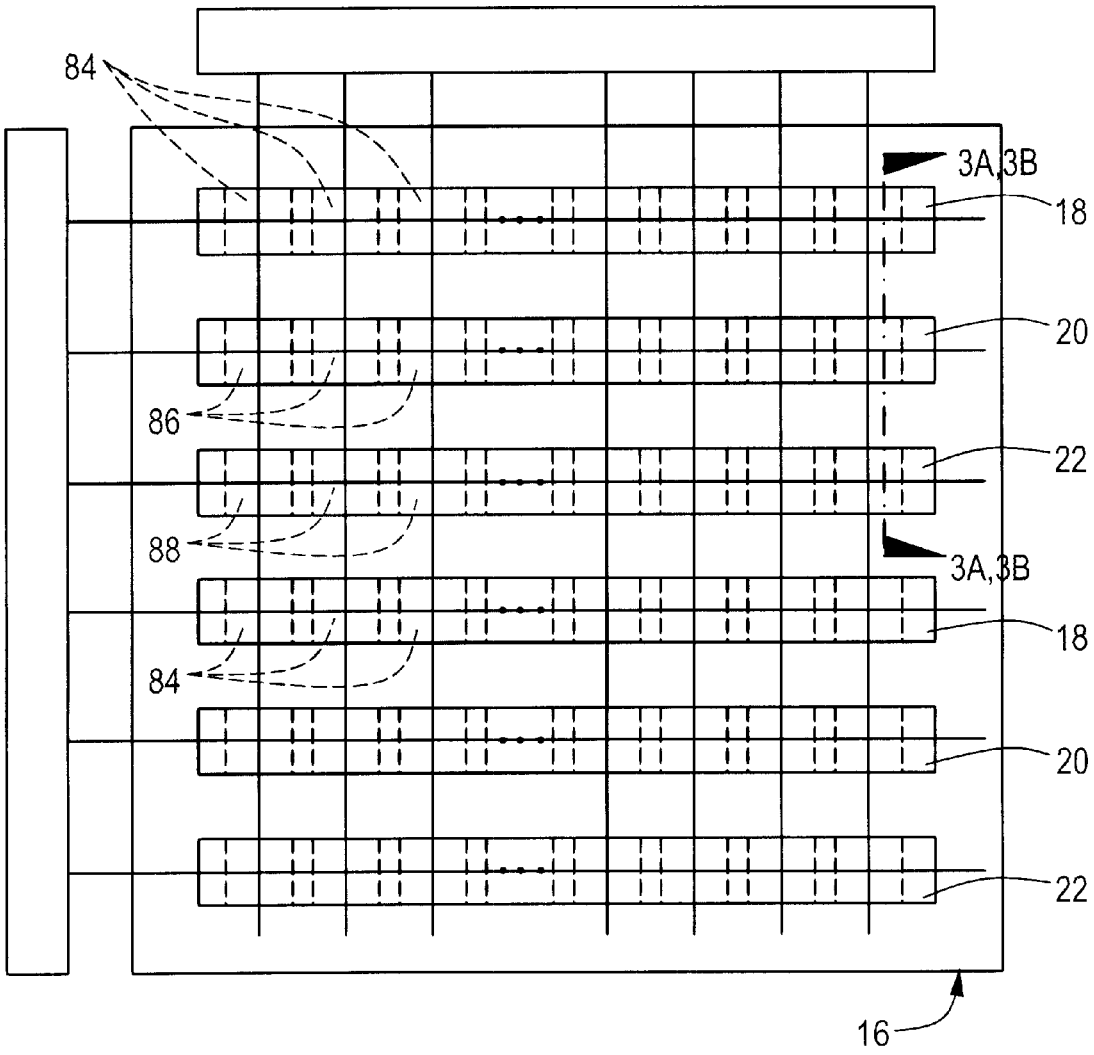
FIG. 2A is a plan view of the first embodiment of an OLED printhead where the printhead comprises a plurality of triplets of arrays where each array in the triplet emits radiation in a distinct range of wavelengths.
Figure 3A:
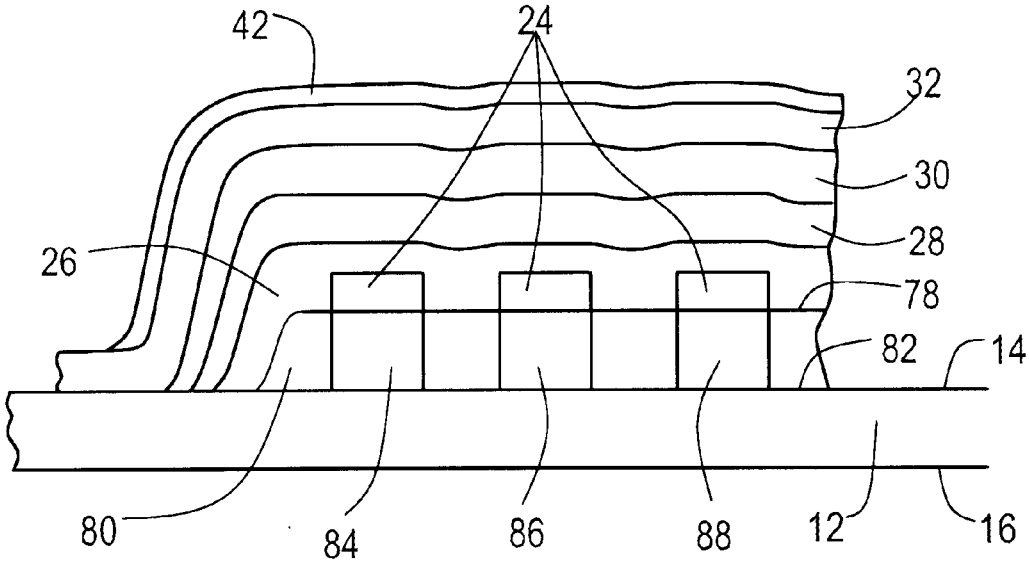
FIG. 3A is a cross-sectional view, for passively addressable OLED structure, across three arrays in the triplet of FIG. 2A and illustrates the components of a passively addressable OLED structure.

The printhead shown in FIG. 2A includes at least one triplet (three) of elongated arrays of individually addressable Organic Light Emitting Diode (OLED) elements 18, 20 and 22 and elongated arrays of color filters 84, 86 and 88, each OLED array in the triplet in effective light transmission relation to the light receiving surface of one color filter array in the triplet thereby constituting an OLED color filter array set. The OLED arrays 18, 20 and 22 emit light (the term "light" is synonymous to radiation) over a broad range of wavelengths, for example, over the entire visible range. At least one triplet of color filter arrays is placed in effective light transmission relation to OLED arrays. In this embodiment it is the color filters that determine the wavelength range (for example red, green or blue) of the radiation emitted by the print head. Each color filter array in each triplet is capable of transmitting radiation in a distinct wavelength range different from the distinct wavelength range of the other two arrays in the triplet. The color filter arrays are located directly underneath the OLED arrays (deposited onto the light receiving surface of the substrate). Referring to FIG. 2A, which is a plan view of the printhead, color filter arrays 84, 86 and 88 are deposited onto and in effective light transmission relation to the light receiving surface of the substrate. The elements of the color filter arrays 84, 86 and 88 are shown in dashed (--) lines underneath the OLED arrays 18, 20 and 22. A cross sectional view of this embodiment is shown in FIG. 3A.

Figure 2B:
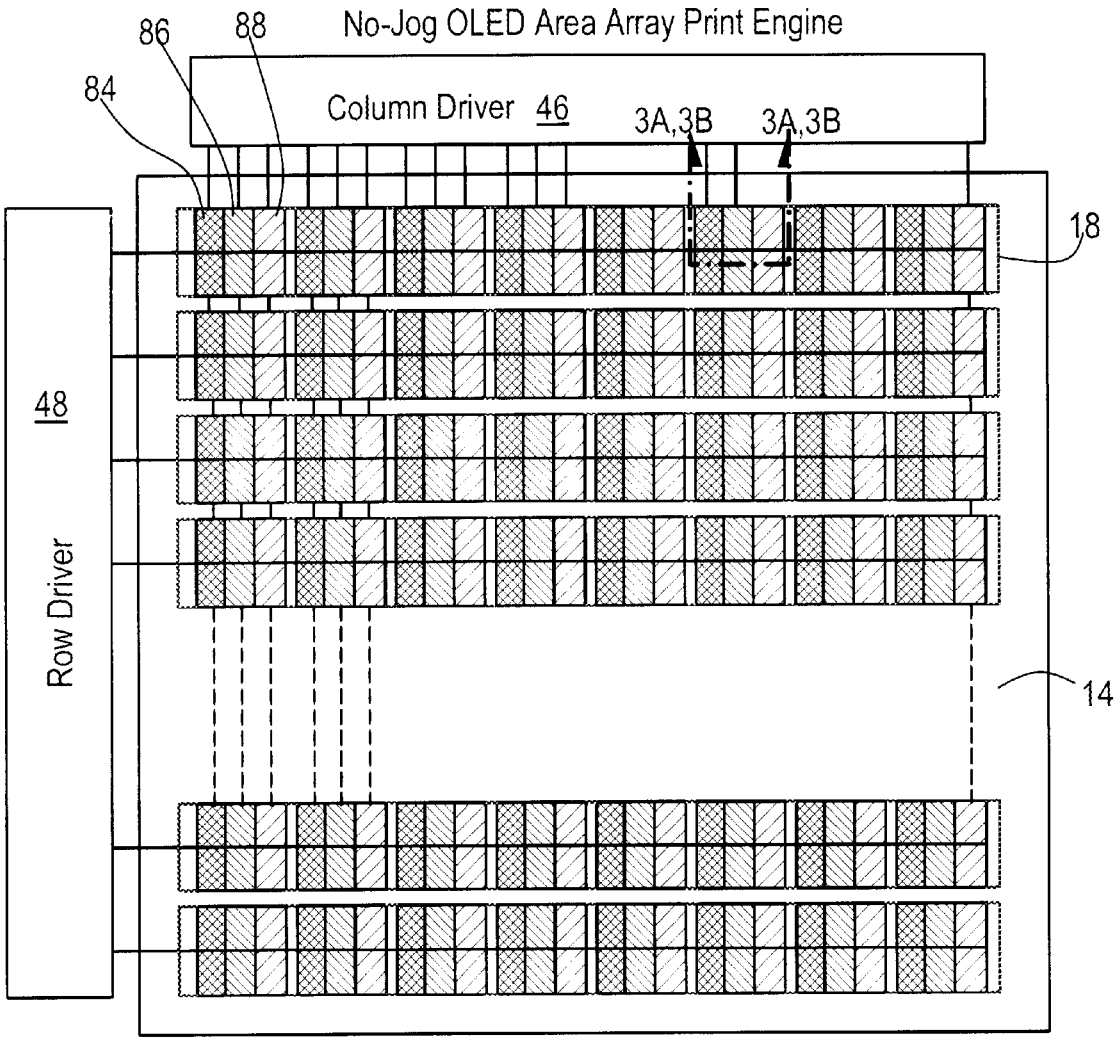
FIG. 2B is a plan view of the second embodiment of an OLED printhead where each array is comprised of a plurality of triplets of OLED elements and each element in each of the triplets emits radiation in a distinct wavelength range.
Figure 3B:
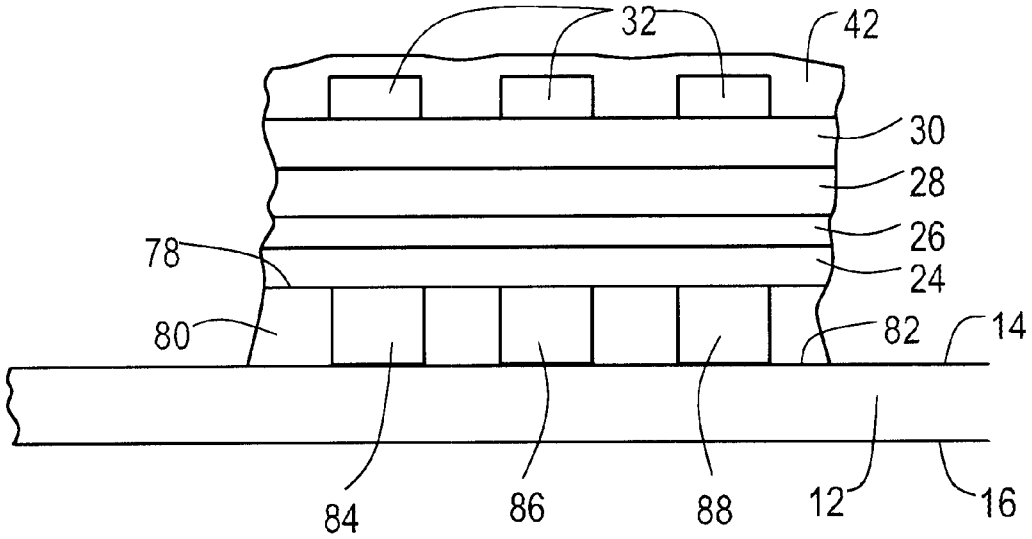
FIG. 3B is a cross-sectional view, for passively addressable OLED structure, across three arrays of FIG. 2B and illustrates the components of a passively addressable OLED structure in FIG. 2B.

In an alternative arrangement of this embodiment, shown in FIG. 2B, each color filter array is comprised of at least one of a plurality of triplets of color filters 84, 86 and 88, and each element in each triplet is capable of transmitting radiation in a distinct wavelength range different from the distinct wavelength range of the other two color filters in the same triplet (red, green, and blue for example). A cross sectional view for this embodiment is shown in FIG. 3B. Comparing FIG. 3B with FIG. 3A, it can be seen that the most significant difference is the orientation of the cathode and anode electrodes which is indicative of the fact that FIG. 3A represents a cross section across three arrays while FIG. 3B represents a cross section along an array.

The (anode) row and (cathode or bus) column electrodes of the OLED arrays, in either FIG. 2A or FIG. 2B, can, in one embodiment, be extended beyond the OLED structure in order to constitute conductive lines or metallic contacts. In that embodiment, the driver control circuits 46 and 48 for selectively controlling the energizing of said Organic Light Emitting Diode (OLED) elements are connected to the row and column electrodes by electrical connection means such as elastomer connectors (sometimes called "zebra links": commercial examples are L type connectors from Potent Technology Inc., and "G" type connectors from ARC USA/GoodTronic Corporation). Other electrical connection means for selective connection of the individually addressable light emitting elements to the driver circuits are conductive interconnecting lines. The conductive interconnecting lines can be selectively deposited on the light receiving surface of the fiber optic faceplate substrate in a manner whereby they provide connecting means. If conductive interconnecting lines are used, the driver control circuits 46 and 48 are connected by means, such as wire bonding or solder bumping, to selected ones of the conductive interconnecting lines. (The driver control circuits could be mounted on the light receiving surface of the substrate 14, or could be located elsewhere. if mounted elsewhere the connection means will also include electrical leads and connectors as is well known to those schooled in the art.) The conductive interconnecting lines can be connected to the individually addressable OLED elements either by means of the deposition process or by wire bonding or solder bumping. It should also be apparent to those skilled in the art that it is possible to extend and position the electrodes from the rows and columns to constitute the conductive interconnecting lines.

The OLED is energized when a voltage is placed across the anode and cathode terminals. In analogy to liquid crystal displays, it is possible to construct both actively addressable and passively addressable OLEDs. In an actively addressable OLED structure, there is additional circuitry that allows selecting an element in the structure. Referring to FIG. 1, for passively addressable OLEDs, the OLED structure consists of transparent anode rows 24, organic layers 25 and cathode columns 32. Referring to FIG. 2A and FIG. 2B, the driver control circuits 46 and 48 for selectively controlling the energizing of said Organic Light Emitting Diode (OLED) elements are connected to the row and column electrodes. The driver control circuits 46 are connected to the column electrodes of OLED arrays. The driver control circuits 48 are connected to the row electrodes of OLED arrays.

Figure 4:
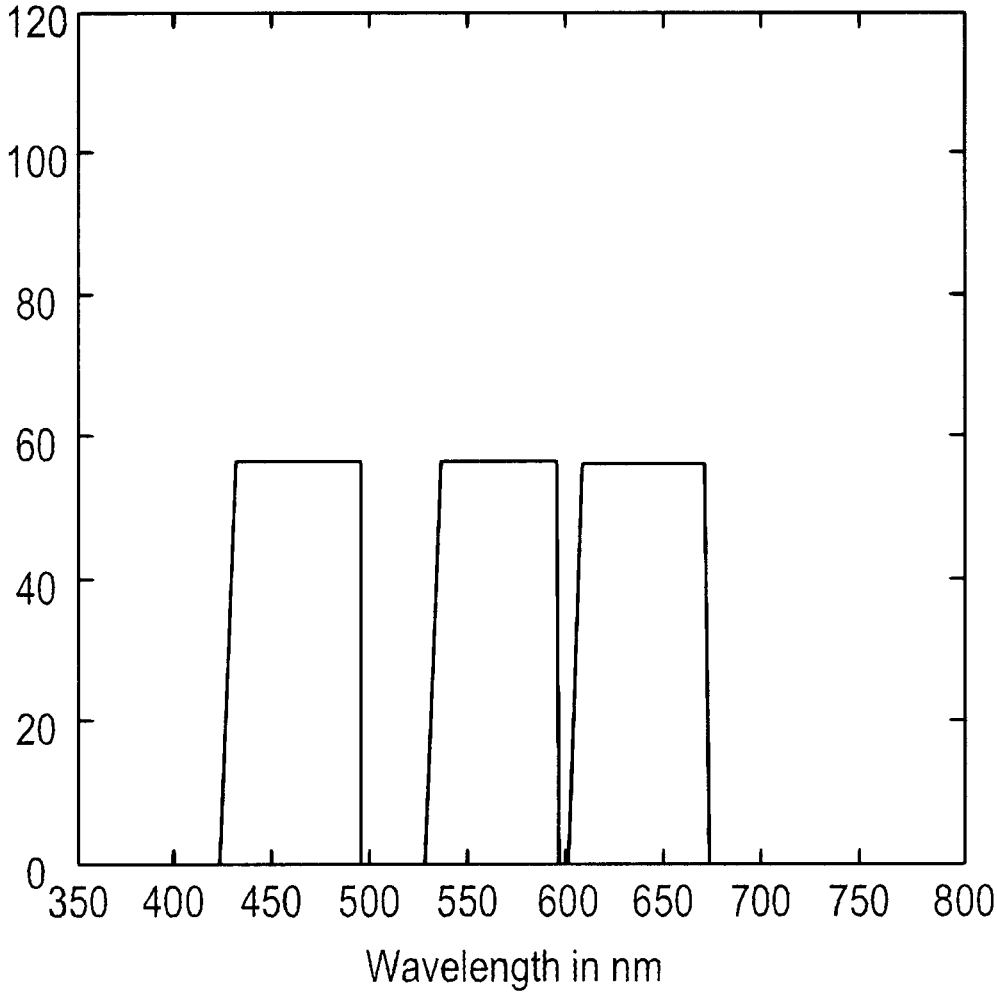
FIG. 4 depicts the transmittance of typical ideal bandpass color filters as a function of wavelength.

A cross sectional view across the three OLED and color filter arrays in FIG. 2A, depicting one element in each array, shown in FIG. 3A, is more illustrative of the embodiment shown in FIG. 2A. Referring to FIG. 3A, which illustrates the passively addressable case, the three color filter elements 84, 86 and 88 are deposited onto and in effective light transmission relation to the light receiving surface of the substrate. Each color filter elements selectively transmits radiation in a different distinct range of wavelengths, for example, red, green and blue. (The transmittance of typical ideal bandpass color filters as a function of wavelength is shown in FIG. 4) Among the techniques that can be used to deposit color filters are the use of photoresist, deposition of organic pigments by vacuum evaporation followed by conventional photolithographic lift-off techniques, thermal printing, and depositing an imageable layer. The color filter are formed from at least one color filter material. In one embodiment, as already stated, of the color filter material is an imageable material. The imageable material is coated onto the light receiving surface of the substrate, as in the configuration shown in FIG. 3A. Examples of imageable materials suitable for constructing color filters are those materials described in U.S. Pat. Nos. 4,602,263; 4,720,449; 4,720,450; 4,745,046; 4,818,742; 4,826,976; 4,839,335; 4,894,358, 4,960,901, 5,582,956; 5,621,118 and 6,004,719. If an imageable layer that is capable, upon exposure, of forming three colors is not transparent in its unexposed form or can be imaged to create a black layer, it is possible to form black grid lines to separate adjacent filter elements. These black grid lines comprise a region substantially adjoining the entire periphery of the color filter and can provide further reduction in crosstalk.

The color filter layer 80 has a substantially planar light receiving surface 78 oppositely spaced apart from and substantially parallel to a substantially planar light emitting surface 82. Referring to FIGS. 3A and 3B, the color filter light emitting surface is in effective light transmission relation to the light receiving surface of the substrate. If an imageable layer is used as the color filter material, the color filters are formed by exposing the light receiving surface of the imageable material with at least one source of radiation, the at least one source of radiation emitting over at least one distinct range of wavelengths. The exposure is performed so as to produce one or many elongated array of color filter elements at one color or distinct range of wavelengths.

Other color filter materials are colorant (dyes) where said colorants are deposited by thermal mass transfer, printing or other deposition technique, such as vapor deposition. A second material has to be used to provide recesses to define the color filters. Definition of the recesses is usually done using photoresist and techniques known to those skilled in the processing art. Removal of the unwanted materials is usually performed by lift-off processes.

The color filter material surface may need to be prepared (passivated) for deposition of the first electrode in the OLED array structure. In the configuration of FIG. 3A, a material such as indiumn tin oxide which is a transparent conductor, or a combination of a layer of high refractive index material, a conductive layer, and another high index layer (for example, ITO, silver or silver/gold, and ITO as described in WTO publication WO 99/36261), is deposited onto the prepared color filter material surface by vacuum deposition techniques such as sputtering or evaporation. (The above discussion also applies to FIG. 3B, since it differs structurally from FIGS. 3A only in the orientation of the cathode and anode electrodes.)

Referring again to FIG. 3A, and FIG. 3B, the hole transport layer 26 is deposited on the transparent electrode 24. Then, electroluminescent layer 28 and an electron transport layer 30 are deposited on the hole transport layer 26. Since all OLED elements emit at the same broad range of wavelengths, the electroluminescent layer can be deposited continuously and is the same for all OLED elements. Since the radiation emission areas are defined by the color filters, these organic layers do not need to be patterned into arrays. A cathode structure 32 is deposited next using vacuum deposition techniques. For a passive addressing OLED printhead the cathode structure is a conductive material structure such as a magnesium silver alloy layer and silver layer or metals such as silver, gold, aluminum, copper, calcium magnesium or a combination thereof. The conductive material 32 in FIG. 2 forms a column electrode. For an active addressing OLED printhead a structure consisting of a conductive material and a transistor switch (at least two transistors and a capacitor) at each element is required. Finally, a protective coating 42 is deposited by any of a variety of means (similar to the organic layers).

Any color filter element in the array has characteristic surface dimensions which are substantially the same for all color filter elements in the array and from which a center point can be defined. It is possible to define, for each center point, an image point at the opposite color filter surface. The image point is located along a line passing through the center point and perpendicular to the surface on which the center point is located. The color filter center point, the image point and the line connecting them define points and an axis used for alignment.

The anode and the cathode define an OLED element that has characteristic surface dimensions which are substantially the same for all OLED elements and from which a center point can be defined. In one method of aligning the center point of an OLED element with the center point of the respective color filter element, during deposition, the OLED center points are used in conjunction with the color filter center points, the respective color filter image points and the lines connecting the color filter center points and the respective color filter image points to ensure that OLED center points are simultaneously substantially collinear with the corresponding image points of said color filter center points (that is, the OLED elements are aligned with the respective color filter elements). Other alignment techniques known to those skilled in the material processing and deposition art can be used.

Exposing a photosensitive material with the printhead of FIG. 2A occurs in the following manner. The printhead is placed over the photosensitive material such that the planar light emitting surface of the substrate is oppositely spaced apart at a given distance from and substantively parallel to the light receiving surface of the photosensitive material. In the passive addressing mode as would be the case for printing on highly sensitive instant silver halide film, one row at a time is addressed and printed before multiplexing to the next row. At the completion of addressing and printing all the rows that emit in one wavelength range (red, for example), the OLED print engine is moved one row relative to the film plane and the addressing and printing process repeated with next wavelength range (for example, green). This movement occurs in the direction perpendicular to both the distance between the printhead and the light receiving surface of the photosensitive material. This shifting and printing operation is repeated one more time such that every image pixel in the frame can be exposed to, for example, red, green and blue light (FIG. 2A). For a line exposure, the method is the same as in the preceding discussion but the printhead has to be returned to one starting location or the process must be carried in reverse order while printing the next line. The total print time, for an area exposure, is dependent on print size and is equal to the number of rows times the sum of the exposure time for each color plus twice the short time to move the print engine one row. In the active addressing mode, where each element has a transistor switch (two transistors and a capacitor), it is possible to energize all the OLEDs at the same time. In this case the total print time is independent of print size and, for an area exposure, is equal to three times the longest exposure time plus, again, the time to move the print engine (or the film) one row, twice.

The printhead of FIG. 2B would not require moving one row relative to the film plane and repeating the addressing and printing process with new data. For the printhead of FIG. 2B, in the passive addressing mode, the total print time, for an area exposure, is dependent on print size and is equal to the number of rows times the longest exposure time for any wavelength range. In the active addressing mode, the total print time is independent of print size and, for an area exposure, is equal to the longest exposure time.

Alignment between a color filter element and the individual glass fibers is not necessary since the characteristic dimensions of the color filter element (which is substantially the same as the characteristic dimensions of the OLED) are much larger than the characteristic dimension of a glass fiber and, therefore, one color filter element illuminates several fibers.

OLED Structure Coupled to the Fiber Optic Faceplate

Figure 5:
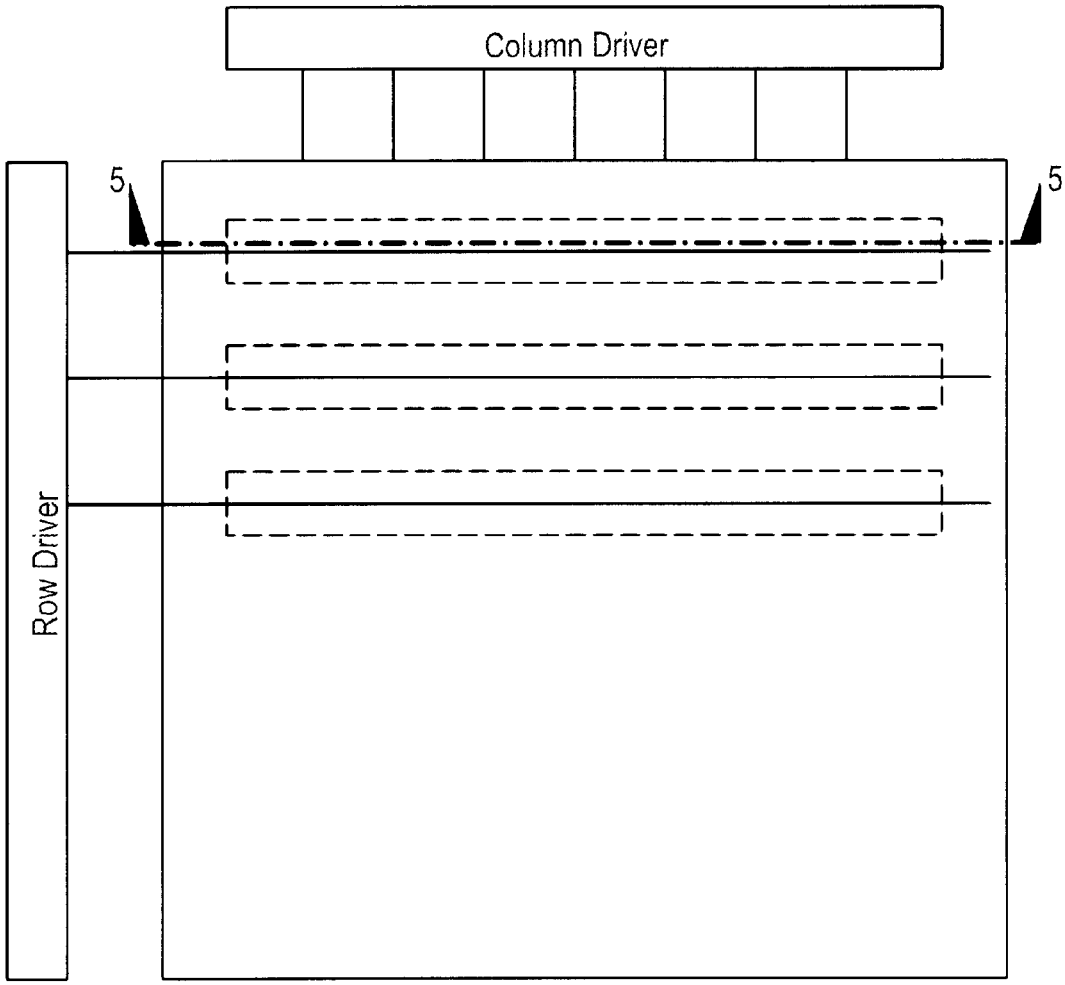
FIG. 5 is a top view of a printhead in which the OLED—Color Filter structure is on a separate substrate.
Figure 6:
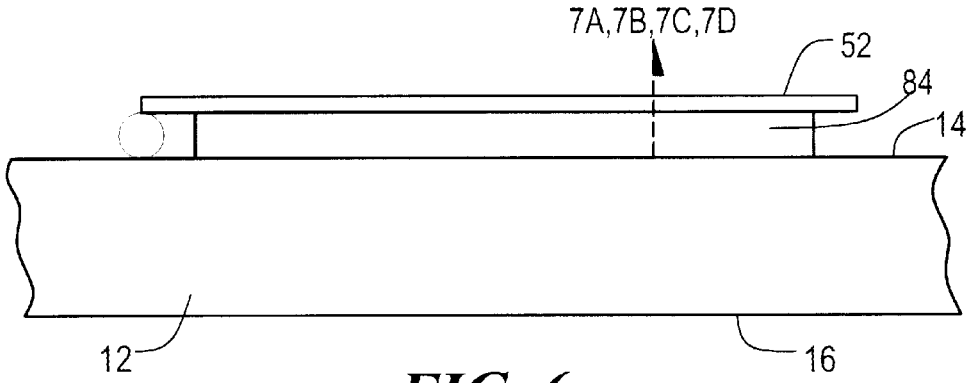
FIG. 6 is a side view of a printhead in which the OLED—Color Filter structure is on a separate substrate.
Figure 7A:
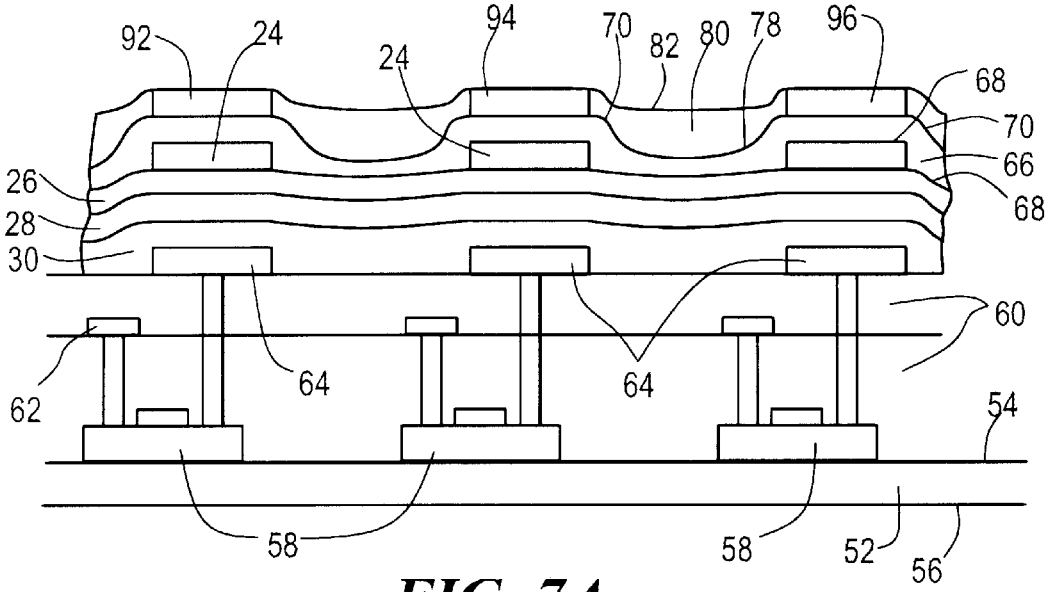
FIG. 7A is a cross-sectional view, for an actively addressable OLED structure, across three arrays and the underlying OLED structure in the triplet of a printhead embodiment similar to that of FIG. 2A in which the OLED—Color Filter stucture is on a separate substrate; and, the Fig. illustrates the components of an actively addressable OLED structure and the color filter arrays for the configuration in which the color filter arrays are deposited onto the light emitting surface of the transparent layer.
Figure 7B:
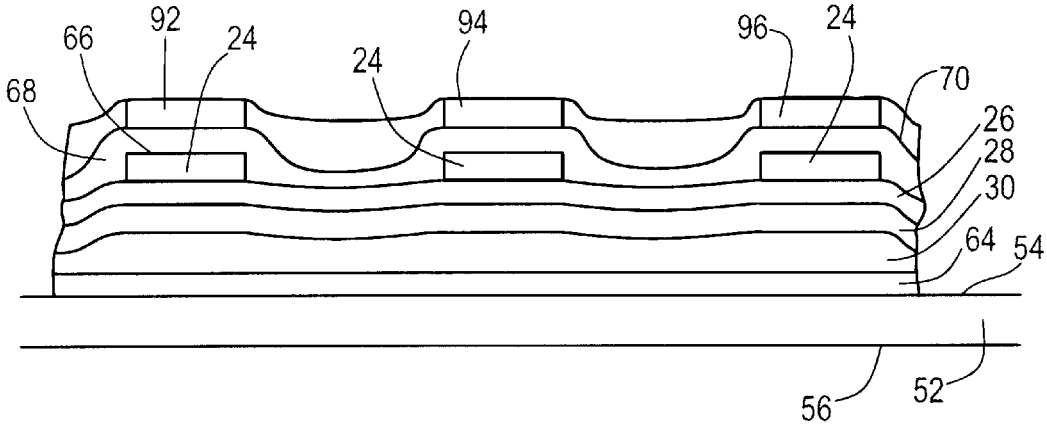
FIG. 7B is a cross-sectional view, for passively addressable OLED structure, across three arrays and the underlying OLED structure in the triplet of a printhead embodiment similar to that of FIG. 2A in which the OLED—Color Filter structure is on a separate substrate; and, the Fig. illustrates the components of a passively addressable OLED structure and the color filter arrays for the configuration in which the color filter arrays are deposited onto the light emitting surface of the transparent layer.
Figure 7C:
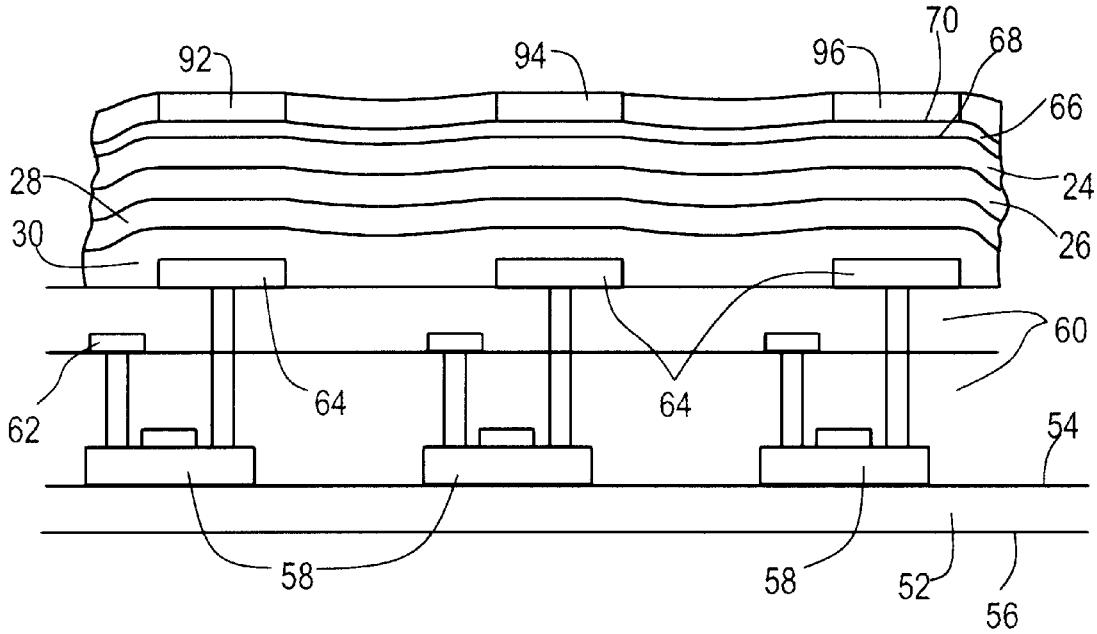
FIG. 7C is a cross-sectional view, for actively addressable OLED structure, along one array set of a printhead embodiment similar to that of FIG. 2B in which the OLED—Color Filter structure is on a separate substrate; and, the FIG. further illustrates the components of an actively addressable OLED structure and the color filter arrays for the configuration in which the color filter arrays are deposited onto the light emitting surface of the transparent layer.
Figure 7D:
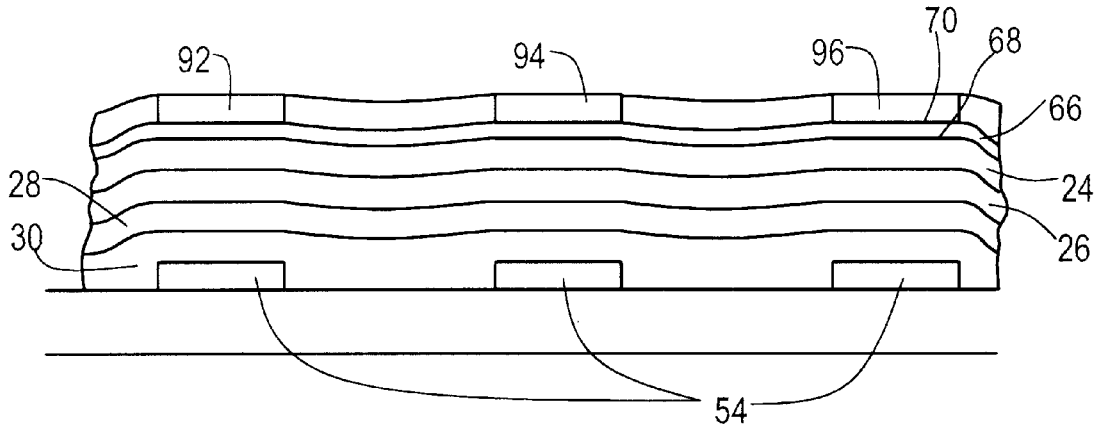
FIG. 7D is a cross-sectional view, for passively addressable OLED structure, along one array set of a printhead embodiment similar to that of FIG. 2B in which the OLED—Color Filter structure is on a separate substrate; and, the Fig. further illustrates the components of a passively addressable OLED structure and the color filter arrays for the configuration in which the color filter arrays are deposited onto the light emitting surface of the transparent layer.
Figure 7E:
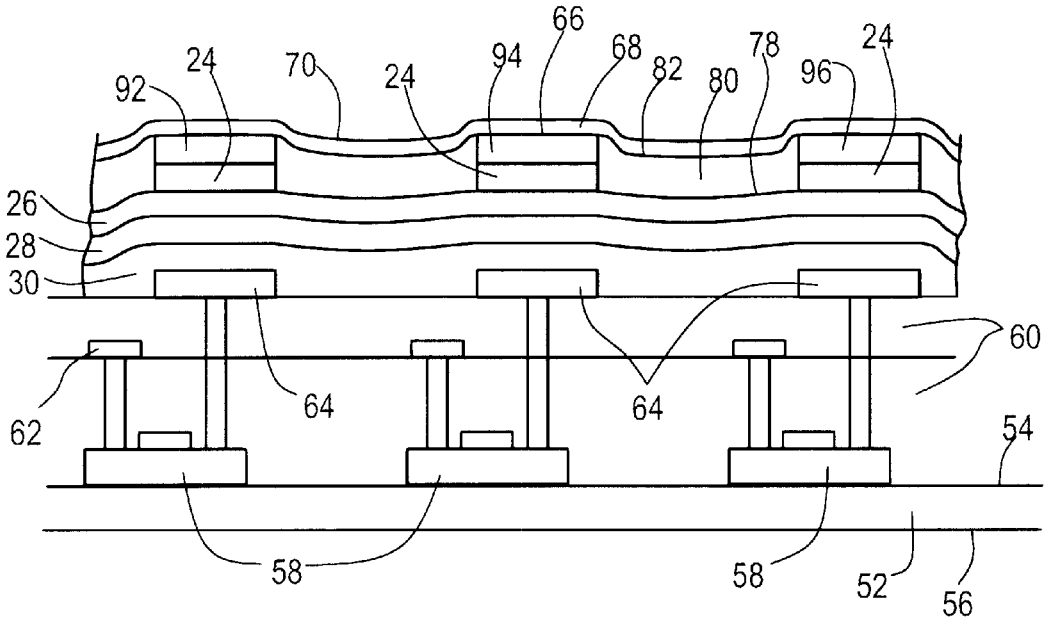
FIG. 7E is a cross-sectional view, for an actively addressable OLED structure, across three arrays and the underlying OLED structure in the triplet of a printhead embodiment similar to that of FIG. 2A and illustrates the components of an actively addressable OLED structure and the color filter arrays for the configuration in which the color filter arrays are deposited onto the OLED structure.
Figure 7F:
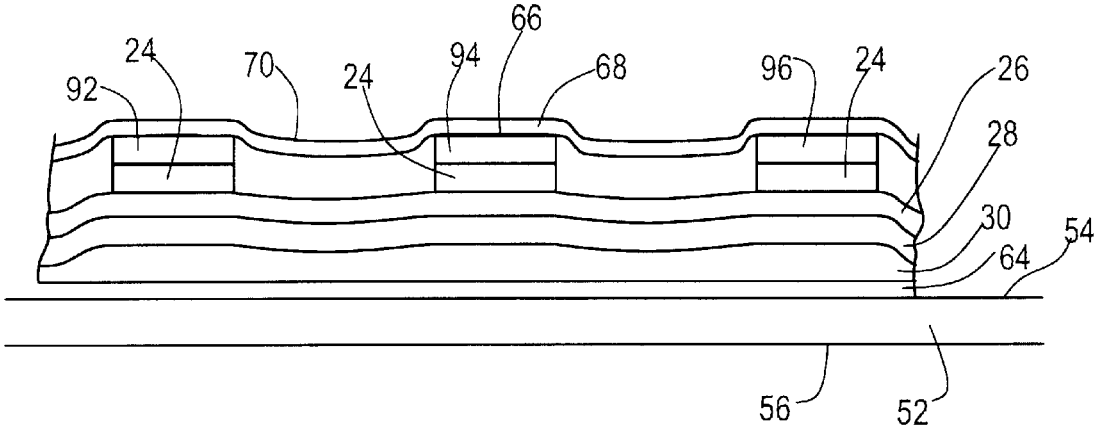
FIG. 7F is a cross-sectional view, for passively addressable OLED structure, across three arrays and the underlying OLED structure in the triplet of a printhead embodiment similar to that of FIG. 2A and illustrates the components of a passively addressable OLED structure and the color filter arrays for the configuration in which the color filter arrays are deposited onto the OLED structure.
Figure 7G:
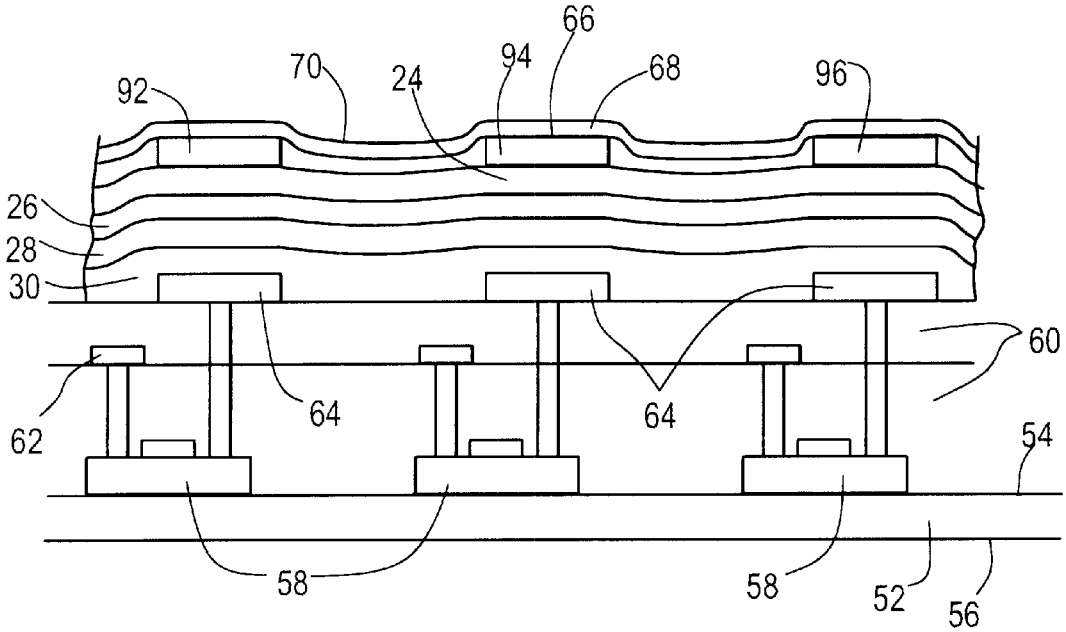
FIG. 7G is a cross-sectional view, for actively addressable OLED structure, along one array set in a printhead embodiment similar to that of FIG. 2B and further illustrates the components of an actively addressable OLED structure and the color filter arrays for the configuration in which the color filter arrays are deposited onto the OLED structure.
Figure 7H:
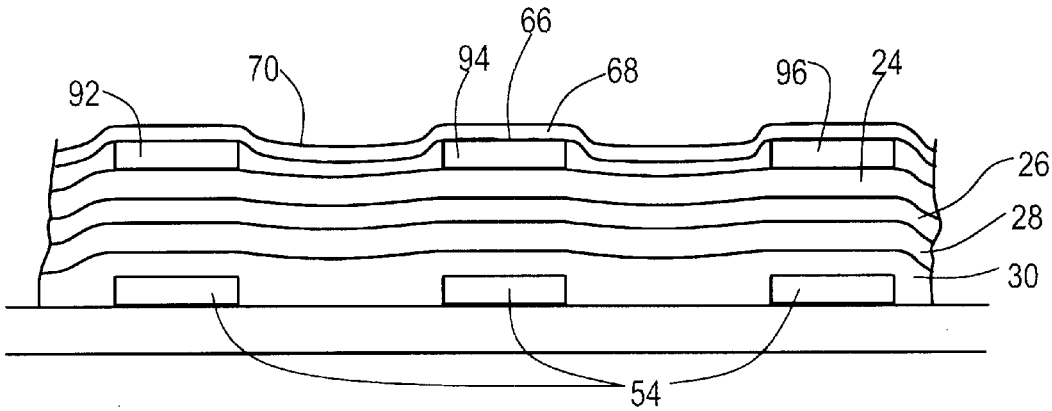
FIG. 7H is a cross-sectional view, for passively addressable OLED structure, along one array set in a printhead embodiment similar to that of FIG. 2B and further illustrates the components of a passively addressable OLED structure and the color filter arrays for the configuration in which the color filter arrays are deposited onto the OLED structure.

In some cases of interest, it is advantageous to construct the OLED—Color Filter structure on a separate substrate and mechanically couple the structure to the fiber optic faceplate. Referring to FIGS. 5–7, there is shown a printhead comprising a fiber optic faceplate substrate 12 and an OLED—Color Filter structure 84 on a separate substrate 52 disposed on the fiber optic faceplate substrate. The OLED—Color Filter structure can be a passively addressable structure or an actively addressable structure. The OLED—Color Filter structure is configured in one of two arrangements. In both of the arrangements, the OLED—Color Filter structure comprises at least one elongated array of individually addressable Organic Light Emitting Diode (OLED) elements emitting radiation over a broad range of wavelengths (for example, white light) and at least one elongated array of color filter elements, where the color filter elements selectively transmit radiation in a distinct range of wavelengths. In one arrangement, the view of the OLED—Color Filter structure from the light receiving surface of the fiber optic faceplate substrate is similar to FIG. 2A. In another arrangement of the OLED—Color Filter structure, the view from the light receiving surface of their fiber optic faceplate substrate is similar to FIG. 2B. That is, in one arrangement the printhead comprises a plurality of triplets of elongated arrays of individually addressable Organic Light Emitting Diode (OLED) elements and elongated arrays of color filters; where each OLED array in the triplet is in effective light transmission relation to the light receiving surface of one color filter array in the triplet thereby constituting an OLED color filter array set; and, each color filter array in each triplet is capable of transmitting radiation in a distinct wavelength range different from the distinct wavelength range of the other two arrays in the triplet (similar to FIG. 2A). In another arrangement, the at least one color filter array in the OLED—Color Filter structure is comprised of a plurality of triplets of color filters, each element in each triplet being capable of emitting radiation in a distinct wavelength range different from the other two elements in the same triplet (similar to FIG. 2B). Also in both of the arrangements, an OLED—Color Filter structure substrate 52 having a substantially planar first surface 54 oppositely spaced apart from and substantively parallel to a substantially planar second surface 56 serves a base on which to deposit the individually addressable arrays of Organic Light Emitting Diode (OLED) and the color filter array.

Details of the structure of OLED elements and color filter elements are shown in FIGS. 7A, 7B, 7C, 7D, 7E, 7F, 7G and 7H. In the embodiment shown in FIGS. 7A, 7B, 7C and 7D, a substantively transparent layer is deposited onto the OLED structure, this layer having a light receiving surface in effective light transmission relation to the transparent anode, the light receiving surface is oppositely spaced apart from a light emitting surface, and a color filter material deposited onto the light receiving surface of the transparent layer. In the embodiment shown in FIGS. 7E, 7F, 7G and 7H, at least one of a plurality of elongated array of color filter elements, having a substantially planar color filter light receiving surface oppositely spaced apart from and substantively parallel to a substantially planar color filter light emitting surface, is deposited onto the OLED structure and a substantively transparent layer is deposited onto the at least one of a plurality of elongated array of color filter elements. Referring to FIGS. 7A, 7B, 7C, 7D, 7E, 7F, 7G and 7H, a substrate 52 serves as a base on which to deposit individually addressable Organic Light Emitting Diode (OLED) structure. The substrate material could be glass, a plastic substrate suitable for deposition, or a semiconductor wafer. Referring to FIGS. 7A, 7C, 7E, and 7G, specific to actively addressable OLED structures, the transistor switch 58 is deposited on the first surface 54 of the substrate 52. (FET transistor switches are well-known to those skilled in the art. Inuka et al. have shown a transistor switch configuration in the Sid 00 Digest, p. 924. It should be apparent to those skilled in the art how to modify that switch in order to connect the cathode to the transistor.) A planarizing layer 60 separates the transistor switch from the busses and contact pads 62 and the busses and contact pads 62 from the cathode structure 64. The planarizing layer could be constructed out of a material like silicon oxide ($SiO_2$) and the cathode structure is a conductive material structure of the appropriate work function such as a magnesium silver alloy layer and silver layer or metals such as silver, gold, aluminum, copper, calcium, magnesium or a combination thereof deposited using vacuum deposition techniques. Both types of OLED structures include a cathode 64, a plurality of layers of organic materials, and a transparent anode 24.

For passively addressable OLED structures, shown in FIGS. 7B, 7D, 7F, and 7H, a cathode structure 64 is deposited on the first surface 54 of the substrate. (As will be readily apparent to those skilled in the art, deposition on a substrate also includes preparing the surface, by planarizing it or passivating it, if any preparation is needed.)

Referring again to FIGS. 7A, 7B, 7C, 7D, 7E, 7F, 7G and 7H, the organic layers 26, 28 and 30 are deposited next. An electron transport layer 30, which is common to the arrays emitting at all three wavelengths, is deposited first. Then, an electroluminescent layer is deposited for each array. The OLED elements emit light (radiation) over a broad range of wavelengths, for example, white light, and, therefore, the electroluminescent layer is continues. It is possible to combine the electroluminescent layer and the electron transport layer into one layer. In this case, layer 30 is absent. Next, a hole transport layer 26 is deposited.

Next, a transparent conducting layer 24 which serves as an anode is deposited. The anode layer consists of a material such as indium tin oxide which is a transparent conductor, or a combination of a layer of high refractive index material, a conductive layer, and another high index layer (for example, ITO, silver or silver/gold, and ITO as described in WTO publication WO 99/36261), and is deposited by vacuum deposition techniques such as sputtering or evaporation. In order to create the row pattern, techniques well known to those skilled in the art, such as photoresist and etching techniques or laser ablation, are used to remove the excess material.

Referring to FIGS. 7A, 7B, 7C and 7D, a substantially transparent layer is deposited next. The transparent layer 66 has a light receiving surface 68 in effective light transmission relation to the color filter array, and, the light receiving surface 68 is oppositely spaced apart from a light emitting surface 70. The color filter material is deposited onto the light receiving surface of the transparent layer.

Referring to FIGS. 7E, 7F, 7G and 7H, the color filter material is deposited onto the transparent anode in the OLED structure. A transparent layer is deposited onto the color filter array.

The transparent layer could be acrylic or polycarbonate or a transparent polymer and can be deposited by techniques such as coating or spin coating. (The term transparent or substantially transparent describes a material that has a substantial transmittance over the broad range of wavelengths of interest, that is, the range of wavelength of OLED emission or all the color filter transmission. For comparison the typical commercial specification for transparent electrodes requires that two superposed electrodes will I have a transmittance of at least 80% at 550 nm.)

The printhead of FIGS. 5–7 also comprises at least one of a plurality of elongated arrays of color filter elements 92, 94 and 96, where the color filter elements selectively transmit radiation in a distinct range of wavelengths. As previously described, the color filter center points, the color filter image points and the lines connecting the color filter center points and the respective color filter image point can be identified and similarly, for the OLED elements, characteristic surface dimensions, which are substantially the same for all OLED elements and from which a center point can be defined, can be identified. Thus, it is possible to ensure that OLED center points are simultaneously substantially collinear with the corresponding image points of said color filter center points (that is, the OLED elements are aligned with the color filters). Alignment techniques known to those skilled in the material processing and deposition art can be used.

It is possible to construct an actively addressable structure with a transparent cathode. In that case (not shown), the transistor switch is deposited in the closest proximity to the first surface, the anode is deposited next, the organic layers are then deposited in reverse order from those of FIGS. 7A, 7B, 7C, 7D, 7E, 7F, 7G and 7H. That is, the hole transport layer is deposited onto the anode, followed by the electroluminescent layer, and, finally an electron transport layer. A transparent cathode is then deposited. A transparent cathode consists of a thin layer of a conductive material structure of appropriate work function such as a magnesium silver alloy or magnesium layer followed by a layer of a transparent conductive material such as indium tin oxide (ITO) (see WTO publication WO 99/20081 A2 and WTO publication WO 98/1061122 A1 and references therein).

Referring again to FIGS. 5 and 6, the anode rows and the busses, in the case of actively addressable OLED structures, or the cathode columns, in the case of passively addressable OLED structures, can, in one embodiment, be extended beyond the OLED structure in order to constitute metallized contacts. The choice of the electrical connection means used for connecting selected ones of the individually addressable light emitting elements in the OLED structure selected ones of the driver control circuits 46 and 48 depends on the choice of mechanical coupling means used to mechanically couple the OLED—Color filter structure to the fiber optic faceplate substrate.

In one configuration, the electrical connection means for selective connection of the individually addressable light emitting elements to the driver circuits are conductive interconnecting lines. The conductive interconnecting lines selectively deposited on the light receiving surface of the fiber optic faceplate substrate. The metallized contacts are electrically connected to respective ones of the conductive interconnecting lines by a conventional solder bumping process. The driver control circuits 46 and 48 are connected by means, such as wire bonding or solder bumping, to selected ones of the conductive interconnecting lines. Since the electrical connections to the fiber optic faceplate substrate 12 are made on the first surface of OLED substrate, the connection technique is generally referred to as the flip chip/solder bumping process. Permanently attaching the metallized contacts to selected ones of the conductive interconnecting lines by soldering (or similar methods) mechanically couples the OLED—Color filter structure to the fiber optic faceplate substrate.

In another configuration the OLED—Color filter structure is bonded to the fiber optic faceplate substrate using an index matched adhesive (index matched adhesives are well known in optical fabrication). In this configuration, the driver control circuits 46 and 48 for selectively controlling the energizing of the Organic Light Emitting Diode (OLED) elements are connected to the row electrodes and busses by electrical connection means such as elastomer connectors (sometimes called "zebra links"). (The driver control circuits could be mounted on the first surface of the substrate 54, or could be located elsewhere. if mounted elsewhere the connection means will also include electrical leads and connectors as is well known to those schooled in the art).

For the printhead arrangement similar to that of FIG. 2A but where the OLED structure is on a separate substrate. That is, the OLED structure comprises at least one of a plurality of triplets of elongated arrays of individually addressable Organic Light Emitting Diode (OLED) elements and elongated arrays of color filters, each OLED array in the triplet in effective light transmission relation to the light receiving surface of one color filter array in the triplet thereby constituting an OLED color filter array set. And, each array set in the triplet is aligned in substantially parallel spaced relation with respect to each other array set in the triplet; and each triplet is aligned in substantially parallel spaced relation with respect to any other array set triplet. Another printhead arrangement for an OLED structure that is on a separate substrate is similar to that of FIG. 2B; that is, each color filter array is comprised of a plurality of triplets of color filters, and each element in each triplet is capable of transmitting radiation in a distinct wavelength range different from the other two elements in the same triplet (red, green, and blue for example).

Exposure methods for these printheads are identical to those of the printheads of FIG. 2A and FIG. 2B. For the printhead similar to that of FIG. 2A, the total print time, for an area exposure performed with passively addressable OLED elements, is dependent on print size and is equal to the number of rows times the sum of the exposure time for each color plus the short time to move the print engine one row, twice. In the active addressing mode, where each element has a transistor switch (two transistors and a capacitor), it is possible to energize all the OLEDs at the same time. In this case the total print time is independent of print size and, for an area exposure, is equal to three times the longest exposure time plus, again, the time to move the print engine (or the film) one row, twice.

For the printhead similar to that of FIG. 2B, for the passive addressing mode, the total print time is dependent on print size and is equal to the number of rows times the longest exposure time for any wavelength range. In the active addressing mode, the total print time is independent of print size and, for an area exposure, is equal to the longest exposure time.

Alignment between a color filter element and the individual glass fibers is not necessary since the characteristic dimensions of the color filter element (which is substantially the same as the characteristic dimensions of the OLED) are much larger than the characteristic dimension of a glass fiber and, therefore, one color filter element illuminates several fibers.

Optimizing the Printhead Dimensions

In the group of embodiments of the printhead, the radiation emitted from the glass fibers of the fiber optic faceplate due to radiation originating from any OLED element in any array and impinging on the light receiving surface of the photosensitive material defines a pixel area, with a characteristic pixel dimension, on the light receiving surface of the photosensitive material. For a given distance between the planar light emitting surface of the substrate and the light receiving surface of photosensitive material, the spacing between centers of the color filter elements, the distance between the OLED elements and the color filter elements, and the characteristic surface dimensions of the color filter elements, and the numerical aperture (NA) of the fibers are jointly selected so that, at a given pixel area, that pixel area corresponding to a given OLED element, the exposure of the photosensitive material due to the light intensity from the elements of the given array which are adjacent to the given element, is optimized and adequate pixel sharpness is obtained. Details of an optimization procedure and an example for a film type are given below.

Optimization Procedure

Calculating the Intensity at the Pixel Area

Figure 8:
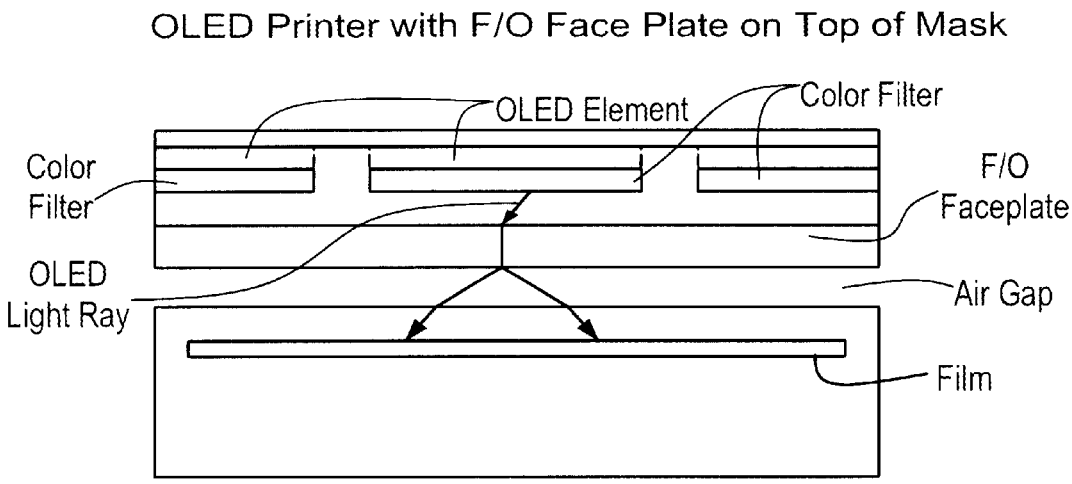
FIG. 8 illustrates the geometry used in calculating the intensity at the pixel area.
Figure 9:
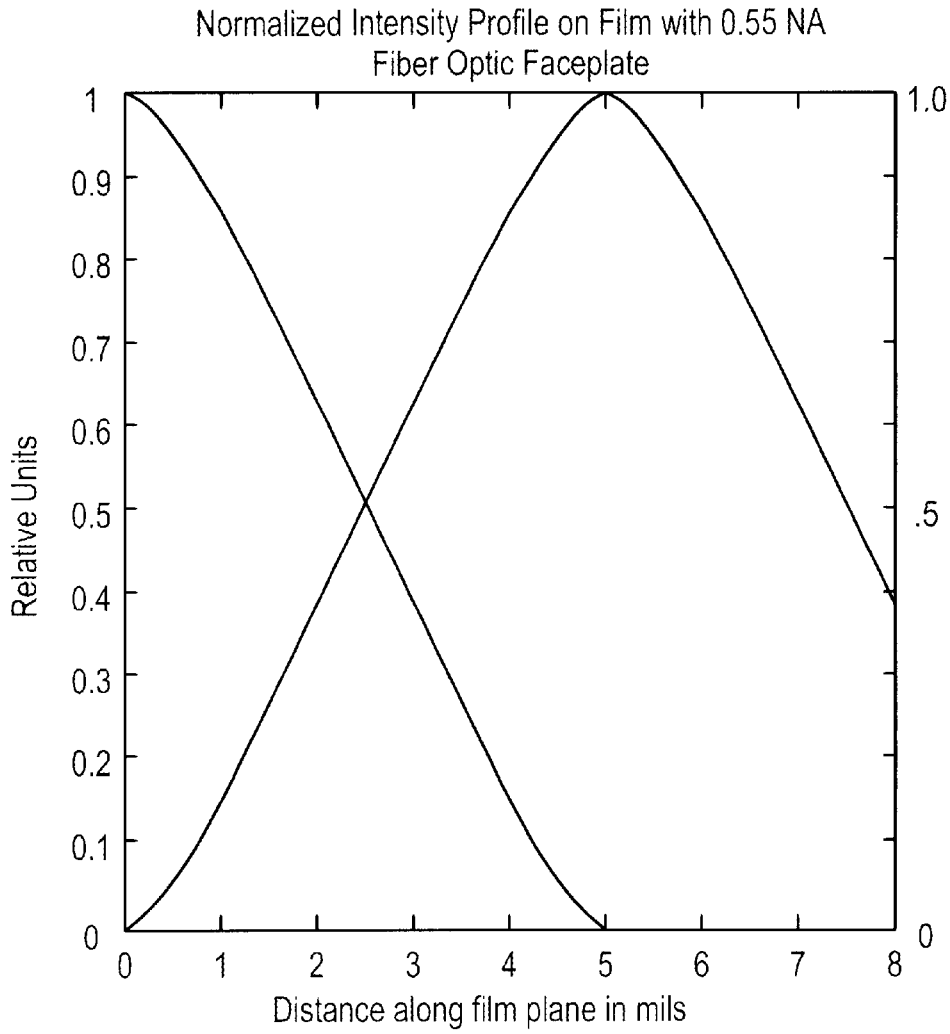
FIG. 9 shows the calculated intensity profile on the film plane from a printead with a 0.55 NA fiber optic faceplate.

In other to calculate the intensity at the pixel area, the spread of the emission from each of the color filter elements is considered to be Lambertian and the spread of the emission from the fibers in the fiber optic faceplate is determined by the numerical aperture (NA). (The intensity is defined as the power emitted per unit solid angle.) Thus, it is possible to calculate the intensity at the pixel area due to a source area taking into account the propagation of the light through the cover of the photosensitive material which has a different index of refraction, as shown in FIG. 8. (A complete and general discussion of how to propagate the radiation from the source to the pixel can be found in Jackson, *Classical Electrodynamics,* $2^{nd}$ edition, pp. 427–432, ISBN 0-471-43132-X). Calculated intensity profiles at a given pixel are shown in FIG. 9. Calculating the pixel area requires taking into account the MTF and sensitivity of the film and the radiation intensity at the pixel location. The method and techniques are well known to those skilled in the art.

Optimization of the Pixel Sharpness

Once the intensity profile at a given pixel, from one OLED element and for a given separation between the printhead and the photosensitive medium, is known it is possible to calculate a measure of the pixel sharpness. The most commonly used measure of pixel sharpness is the SQF (Subjective Quality Factor). The SQF is defined from the intensity profile produced by one color filter array element at a given pixel location at the photosensitive medium. The intensity profile produced by one color filter array element at a given pixel location at the photosensitive medium is the point spread function. To compute the SQF. the point spread function is represented in the spatial frequency domain (for a review of transforms from the space domain to the spatial frequency domain, see Dainty and Shaw, Image Science, Chapter 6, ISBN 0-12-200850-2). The magnitude of the transform of the point spread function is the modulation transfer function, MTF(f). The SQF is defined as $$\frac{\int_{u\min}^{u\max} MTF(u)\,d(\log u)}{\int_{u\min}^{u\max} d(\log u)}$$

where u max and u min are the spatial frequency limits of the of the visual bandpass response.

This is the SQF as defined by Granger and Cupery (Granger, Cupery, *Phot. Sci. Eng.*, Vol. 15, pp. 221–230, 1972), who correlated the calculated SQF with acceptance ranking by observers. They found that an SQF close to 100% obtains the highest quality ranking for sharpness. Thus, the SQF is a good measure of pixel sharpness.

Crosstalk

Crosstalk arises from the fact that emission from the spread of the emission from the fibers in the fiber optic faceplate is determined by the numerical aperture (NA), which means that some of the light emitted from any diode will expose the medium in an adjacent area. In other words, the output from any given diode will expose nearest neighbor image pixels to some extent. Some overlap is acceptable since it leads to a uniform intensity profile. The calculation of crosstalk is similar to that of pixel sharpness. That is, the intensity profile produced by adjacent OLED elements at given pixel locations at the photosensitive medium is calculated. An example is shown in FIG. 9.

Optimization Considerations for the Printheads of FIG. 2B

In the case where each color filter array is comprised of a plurality of triplets of color filters (FIG. 2B), the calculations of pixel sharpness and crosstalk proceed as above except that they are carried out for the elements emitting in the same wavelength range (for example, the elements emitting in the red, or in the green, or in the blue). One additional consideration is the overlap of intensities from different wavelength ranges. This overlap results in a slight loss in color gamut. The intensities for the three wavelength ranges of the triplet, as well as the crosstalk and the point spread function due to elements emitting in the same wavelength range, can be seen in FIG. 10.

Sample Calculations

Photosensitive Medium (Film) 2

For a Photosensitive medium (film) with the properties given in Table 1 and a printhead as shown in FIG. 2A with the parameters given in Table 2, the SQF is 97.7 and the crosstalk, shown in FIG. 9, is acceptable.

TABLE 1

Sensitivity Of Film 2.

Figure 10:
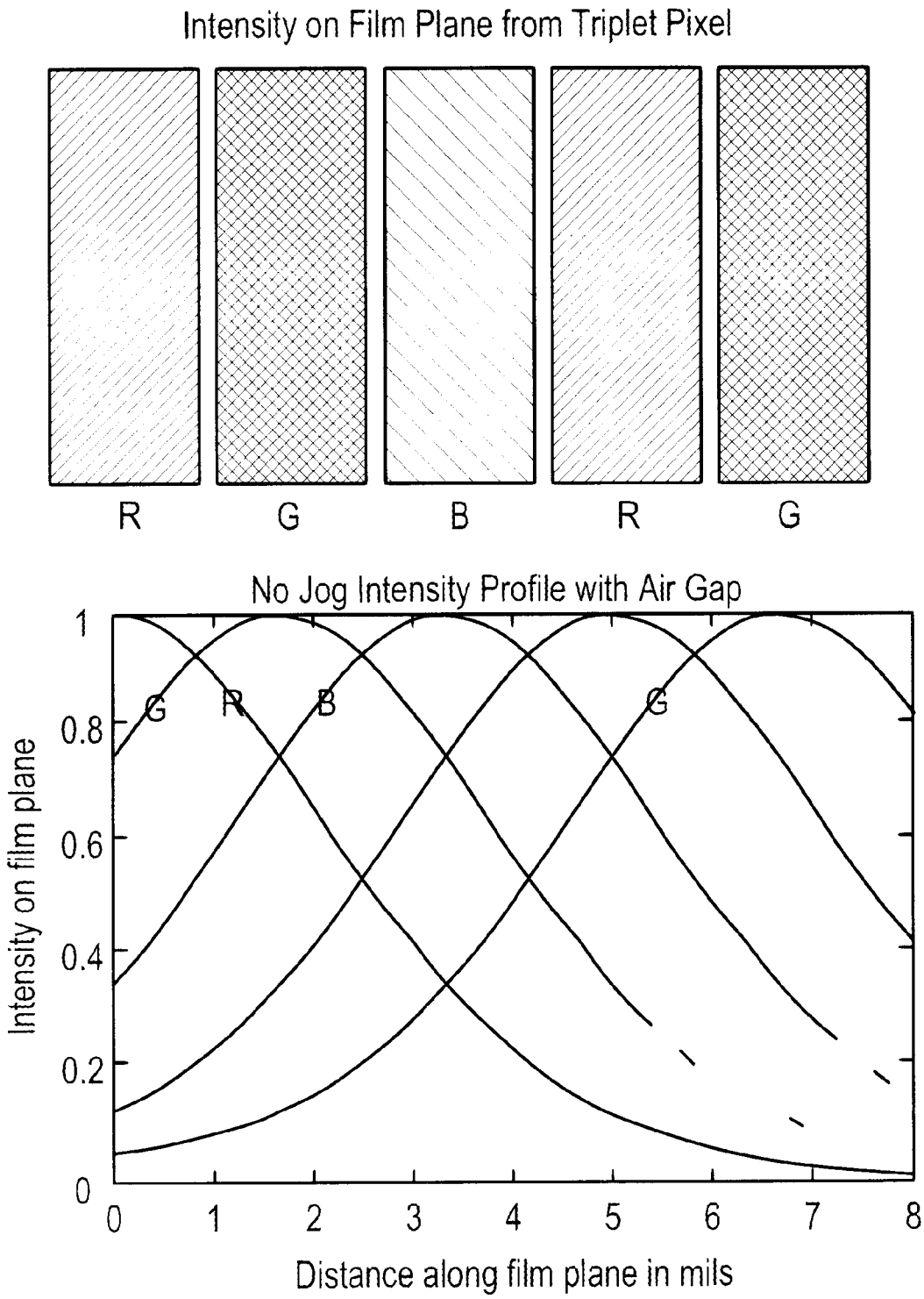
FIG. 10 illustrates the intensity profile on the film plane from a printhead of the configuration shown in FIG. 2B.

| Sensitivity | Joules/cm$^2$ |
|---|---|
| Red, Green or Blue | $1.0 \times 10^{-8}$ |

and a printhead as shown in FIG. 2A with the parameters given in Table 4, the SQF as a function of air gap thickness is shown in the Table 3 and the crosstalk is given in FIG. 10.

TABLE 2

OLED Printer Parameters For The Case Of Film 2.

| OLED printer parameters | |
|---|---|
| DPI | 200 |
| d (Characteristic dimension of OLED = 2 * d) | 2.4 mils |
| Distance between two OLED elements | 5.0 mils |
| Index of refraction of the OLED substrate or cover | 1.485 |

TABLE 3

Pixel SQF As A Function Of Filter Cover Thickness, Air Gap And Film Cover Thickness

| | |
|---|---|
| Filter Cover Refractive Index | 1.48 |
| Filter Cover Thickness (mils) | .5 |
| Mask (air gap) Thickness (mils) | 1.6 |
| Film Cover Sheet Thickness (mils) | 3.5 |
| SQF (pixel) | 97.7 |

Thus, embodiments have been disclosed that provide a printhead that is light weight and compact, where an OLED—Color Filter structure is deposited onto a fiber optic faceplate substrate or where the OLED—Color Filter structure is disposed onto and mechanically coupled to a fiber optic faceplate; and, the printhead is designed for direct printing with the desired pixel sharpness and reduced crosstalk.

Other embodiments of the invention, including combinations, additions, variations and other modifications of the disclosed embodiments will be obvious to those skilled in the art and are within the scope of the following claims.

What is claimed is:

1. An apparatus for exposing a photosensitive material, said photosensitive material having a light receiving surface and being exposed by radiation impinging on said light receiving surface, said apparatus comprising:

an elongated coherent fiber optic faceplate substrate having a substantially planar light receiving surface oppositely spaced apart with respect to a substantially planar light emitting surface, said fiber optic faceplate comprising a plurality of individual glass fibers, each of which has a given characteristic dimension; and an individually addressable Organic Light Emitting Diode (OLED)—Color Filter structure, said structure disposed on the light receiving surface of said fiber optic faceplate substrate, and said structure comprising OLED elements and color filter elements, said OLED elements and color filter elements having characteristic dimensions which are substantially the same to each other and much larger than said given characteristic dimension of said glass fibers so that light transmitted through each of said color filter elements illuminates several glass fibers, whereby alignment between color filter elements and individual glass fibers is not necessary.

2. The apparatus of claim 1 wherein said OLED—Color Filter structure comprises:

at least one elongated array of color filter elements, said color filter elements selectively transmitting radiation in a distinct range of wavelengths, having a substantially planar color filter light receiving surface oppositely spaced apart from and substantively parallel to a substantially planar color filter light emitting surface, any color filter element in the array has a characteristic surface dimension which is substantially the same for all color filter elements in the array and from which a center point can be defined, said color filter being formed from at least one color filter material, said at least one color filter material to form said at least one elongated color filter array being deposited onto and in effective light transmission relation to the light receiving surface of said substrate;

at least one elongated array of individually addressable Organic Light Emitting Diode (OLED) elements, said elements emitting light over a broad range of wavelengths, any OLED element in said array has a characteristic surface dimension which is substantially the same for all OLED elements in the array and from which an OLED center point can be defined, said at least one OLED array being deposited onto and in effective light transmission relation to the light receiving surface of said at least one color filter array, the OLED center points for any said OLED array being substantially collinear and aligned with the respective color filter center points for the color filter array located in effective light transmission relation to that OLED array.

3. The apparatus of claim 2 further comprising:

a plurality of driver control circuits for selectively controlling the energizing of aid Organic Light Emitting Diode (OLED) elements; and means of electrically connecting selected ones of said individually addressable light emitting elements in said OLED structure to said selected ones of said driver control circuits.

4. The apparatus of claim 3 wherein said at least one color filter array is comprised of a plurality of triplets of color filters, and each element in each said triplet being capable of transmitting radiation in a distinct wavelength range different from the other two elements in the same triplet.

5. The apparatus of claim 4 wherein the color filter material is an imageable material.

6. The apparatus of claim 4 wherein the color filter material is a colorant.

7. The apparatus of claim 3 comprising a t least one of a plurality of triplets of said elongated arrays of individually addressable Organic Light Emitting Diode (OLED) elements and said elongated arrays of color filters, each OLED array in the triplet in effective light transmission relation to the light receiving surface of one color filter array in the triplet thereby constituting an OLED color filter array set, each set in the triplet being aligned in substantially parallel spaced relation with respect to each other set in the triplet, each color filter array in each triplet being capable of transmitting radiation in a distinct wavelength range different from the distinct wavelength range of the other two arrays in the triplet, each triplet being aligned in substantially parallel spaced relation with respect to any other triplet.

8. The apparatus of claim 7 wherein the color filter material is an imageable material.

9. The apparatus of claim 7 wherein the color filter material is a colorant.

10. The apparatus of any of claims 2 or 4–9 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface , said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, is optimized. jointly selected so that, at a given pixel area, said pixel area corresponding to a given color filter element in a given color filter array, the exposure of said photosensitive material due to the light intensity from the elements of the given array which are adjacent to the given element and from said element, is optimized.

11. The apparatus in any of claims 4–9 wherein every said color filter element further comprises a region substantially adjoining the entire periphery of said color filter, and said region substantively absorbing radiation in all three distinct wavelength ranges, each said distinct wavelength range being associated with a color filter in a said triplet.

12. The apparatus of claim 11 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area. said pixel area corresponding to a given color filter element in a given color filter array, the exposure of said photosensitive material due to the light intensity from the elements of the given array which are adjacent to the given element and from said element, produces an optimal exposure of the photosensitive material.

13. The apparatus of claim 1 wherein said OLED—Color Filter structure comprises:

a substrate having a substantially planar first surface oppositely spaced apart from a substantially planar second surface; and an OLED structure comprising at least one elongated array of individually addressable Organic Light Emitting Diode (OLED) elements including a transparent anode layer through which exposure light is adapted to be transmitted, said at least one elongated array of Organic Light Emitting Diode (OLED) elements being deposited onto the first surface of said substrate, and wherein said OLED elements emit light over a broad range of wavelengths, any said OLED element in said at least one array has a characteristic surface dimension which is substantially the same for all OLED elements in the array and from which an OLED center point can be defined; and a substantively transparent layer deposited onto the OLED structure, said layer having a light receiving surface in effective light transmission relation to the transparent anode, said light receiving surface oppositely spaced apart from a light emitting surface; and at least one of a plurality of elongated array of color filter elements, said color filter elements selectively transmitting radiation in a distinct range of wavelengths, having a substantially planar color filter light receiving surface oppositely spaced apart from and substantively parallel to a substantially planar color filter light emitting surface, any color filter element in the array has a characteristic surface dimension which is substantially the same for all color filter elements in the array and from which a center point can be defined, said color filter being formed from at least one color filter material, said at least one color filter material to form said at least one elongated color filter array being deposited onto and in effective light transmission relation to the light emitting surface of said substantively transparent layer whereby said color filter light receiving surface is in effective light transmission relation to the light emitting surface of said substantively transparent layer;

wherein the color filter center points for any said color filter array being substantially collinear and aligned with the respective OLED center points for the OLED array located in effective light transmission relation to that color filter array; and wherein, said color filter light emitting surface being in effective light transmission relation to the light receiving surface of said fiber optic faceplate substrate.

14. The apparatus of claim 13 further comprising:

a plurality of driver control circuits for selectively controlling the energizing of aid Organic Light Emitting Diode (OLED) elements; and means of electrically connecting selected ones of said individually addressable light emitting elements in said OLED structure to said selected ones of said driver control circuits.

15. The apparatus of claim 14 wherein said at least one color filter array in said OLED—Color Filter structure is comprised of at least one of a plurality of triplets of color filters, and each element in each said triplet being capable of transmitting radiation in a distinct wavelength range different from the distinct wavelength range of the other two color filters in the same triplet.

16. The apparatus of claim 15 wherein the color filter material is an imageable material.

17. The apparatus of claim 15 wherein the color filter material is a colorant.

18. The apparatus of claim 15 wherein said OLED structure is an actively addressable OLED structure.

19. The apparatus of claim 15 wherein said OLED structure is a passively addressable OLED structure.

20. The apparatus of claim 14 wherein said OLED—Color Filter structure comprises at least one of a plurality of triplets of said elongated arrays of individually addressable Organic Light Emitting Diode (OLED) elements and said elongated arrays of color filters, each OLED array in the triplet in effective light transmission relation to the light receiving surface of one color filter array in the triplet thereby constituting an OLED color filter array set, each set in the triplet being aligned in substantially parallel spaced relation with respect to each other set in the triplet, each color filter array in each triplet being capable of transmitting radiation in a distinct wavelength range different from the distinct wavelength range of the other two arrays in the triplet, each triplet being aligned in substantially parallel spaced relation with respect to any other triplet.

21. The apparatus of claim 20 wherein the color filter material is an imageable material.

22. The apparatus of claim 20 wherein the color filter material is a colorant.

23. The apparatus of claim 20 wherein said OLED structure is an actively addressable OLED structure.

24. The apparatus of claim 20 wherein said OLED structure is a passively addressable OLED structure.

25. The apparatus of any of claims 13 or 15–24 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, is optimized.

26. The apparatus in any of claims 15–24 wherein every said color filter element further comprises a region substantially adjoining the entire periphery of said color filter element, and said region substantively absorbing radiation in all three distinct wavelength ranges, each said distinct wavelength range being associated with a color filter in a said triplet.

27. The apparatus of claim 26 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, produces an optimal exposure of the photosensitive material.

28. The apparatus of claim 1 wherein said OLED—Color Filter structure comprises a substrate having a substantially planar first surface oppositely spaced apart from and substantively parallel to a substantially planar second surface; and an OLED structure comprising at least one elongated array of individually addressable Organic Light Emitting Diode (OLED) elements, said at least one elongated array of Organic Light Emitting Diode (OLED) elements being deposited onto the first surface of said substrate, and wherein said OLED elements emit light over a broad range of wavelengths, any said OLED element in said at least one array has a characteristic surface dimension which is substantially the same for all OLED elements in the array and from which an OLED center point can be defined; and at least one of a plurality of elongated array of color filter elements, said color filter elements selectively transmitting radiation in a distinct range of wavelengths, having a substantially planar color filter light receiving surface oppositely spaced apart from and substantively parallel to a substantially planar color filter light emitting surface, any color filter element in the array has a characteristic surface dimension which is substantially the same for all color filter elements in the array and from which a center point can be defined, said color filter being formed from at least one color filter material, said at least one color filter material to form said at least one elongated color filter array being deposited onto and in effective light transmission relation to the light emitting surface of said the transparent anode; and wherein the color filter center points for any said color filter array being substantially collinear and aligned with the respective OLED center points for the OLED array located in effective light transmission relation to that color filter array; and a transparent layer being deposited onto and having a light receiving surface in effective light transmission relation to said color filter light emitting surface, said light receiving surface oppositely spaced apart from a transparent layer light emitting surface; and wherein, said transparent layer light emitting surface being in effective light transmission relation to the light receiving surface of said fiber optic faceplate substrate.

29. The apparatus of claim 28 further comprising:

a plurality of driver control circuits for selectively controlling the energizing of aid Organic Light Emitting Diode (OLED) elements; and means of electrically connecting selected ones of said individually addressable light emitting elements in said OLED structure to said selected ones of said driver control circuits.

30. The apparatus of claim 29 wherein said at least one color filter array in said OLED—Color Filter structure is comprised of at least one of a plurality of triplets of color filters, and each element in each said triplet being capable of transmitting radiation in a distinct wavelength range different from the distinct wavelength range of the other two color filters in the same triplet.

31. The apparatus of claim 30 wherein the color filter material is an imageable material.

32. The apparatus of claim 30 wherein the color filter material is a colorant.

33. The apparatus of claim 30 wherein said OLED structure is an actively addressable OLED structure.

34. The apparatus of claim 30 wherein said OLED structure is a passively addressable OLED structure.

35. The apparatus of claim 29 wherein said OLED—Color Filter structure comprises at least one of a plurality of triplets of said elongated arrays of individually addressable Organic Light Emitting Diode (OLED) elements and said elongated arrays of color filters, each OLED array in the triplet in effective light transmission relation to the light receiving surface of one color filter array in the triplet thereby constituting an OLED color filter array set, each set in the triplet being aligned in substantially parallel spaced relation with respect to each other set in the triplet, each color filter array in each triplet being capable of transmitting radiation in a distinct wavelength range different from the distinct wavelength range of the other two arrays in the triplet, each triplet being aligned in substantially parallel spaced relation with respect to any other triplet.

36. The apparatus of claim 35 wherein the color filter material is an imageable material.

37. The apparatus of claim 35 wherein the color filter material is a colorant.

38. The apparatus of claim 35 wherein said OLED structure is an actively addressable OLED structure.

39. The apparatus of claim 35 wherein said OLED structure is a passively addressable OLED structure 40. The apparatus of any of claims 28 or 30–39 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, is optimized.

40. The apparatus of any of claims 28 or 30–39 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, is optimized.

41. The apparatus in any of claims 30–39 wherein every said color filter element further comprises a region substantially adjoining the entire periphery of said color filter element, and said region substantively absorbing radiation in all three distinct wavelength ranges, each said distinct wavelength range being associated with a color filter in a said triplet.

42. The apparatus of claim 41 wherein the planar light emitting surface of the fiber optic faceplate substrate is oppositely spaced apart at a given distance from and substantively parallel to the light receiving surface of said photosensitive material, the color filter elements in any of the color filter arrays are spaced apart by a given spacing between centers of the color filter elements, said fiber optic faceplate comprises a plurality of solid glass fibers extending longitudinally between said light receiving surface and said light emitting surface, said fibers having a given numerical aperture, and the radiation emanating from any color filter element in any said array and impinging on said light receiving surface of said photosensitive material defines a pixel area on the light receiving surface of said photosensitive material, said pixel area having a characteristic pixel dimension, and wherein said distance between the planar light emitting surface of the substrate and the light receiving surface of photosensitive material, said spacing between centers of the color filters, said numerical aperture of the fiber, and said characteristic surface dimension of the color filter elements being jointly selected so that, at a given pixel area, said pixel area corresponding to a given color filter element in a given color filter array, the exposure of said photosensitive material due to the light intensity from the elements of the given array which are adjacent to the given element and from said element, produces an optimal exposure of the photosensitive material.

43. A method of exposing a photosensitive material, said material having a light receiving surface, utilizing a printhead, said printhead comprising at least one of a plurality of triplets of elongated arrays sets, each array set in each triplet comprising an array of OLED emitting radiation over a broad range of frequencies and an array of color filter elements, said color filter elements being capable of transmittting radiation in a distinct wavelength range different from the distinct wavelength range of the other two color filter arrays in the triplet, said method comprising the steps of:

placing the printhead over the photosensitive material such that the planar light emitting surface of the substrate is oppositely spaced apart at a given distance from and substantially parallel to the light receiving surface of the photosensitive material; and addressing and printing the elements of the array in each triplet which emits in the first distinct wavelength range; then, displacing the printhead relative to the photosensitive material by one array in the direction perpendicular to both the distance between the printhead and the light receiving surface of the photosensitive material and the direction along the array so that the array in the triplet that emits in the second distinct wavelength range is located substantively at the position of the array which emits in the first distinct wavelength range; then, addressing and printing the elements of the array in each triplet which emits in the second distinct wavelength range; then, displacing the printhead relative to the photosensitive material by one array in the direction perpendicular to both the distance between the printhead and the light receiving surface of the photosensitive material and the direction along the array so that the array in the triplet that emits in the third distinct wavelength range is located substantively at the position of the array which emits in the second distinct wavelength range; then, addressing and printing the elements of the array in each triplet which emits in the third distinct wavelength range.

* * * * *